US005492784A

United States Patent [19]

Yoshikawa et al.

[11] Patent Number: 5,492,784

[45] Date of Patent: Feb. 20, 1996

[54] POSITIVELY-CHARGEABLE SINGLE-LAYERED TYPE ELECTROPHOTOGRAPHIC PHOTOCONDUCTOR

[75] Inventors: Masao Yoshikawa; Masayuki Shoshi; Tetsuro Suzuki, all of Yokohama; Masakatsu Shimoda, Higashi-Kurume; Kaoru Teramura, Kawasaki; Megumi Kawahara, Yokohama; Akio Kojima, Mitaka; Masaomi Sasaki; Masafumi Ohta, both of Susono, all of Japan

[73] Assignee: Ricoh Company, Ltd., Tokyo, Japan

[21] Appl. No.: 102,881

[22] Filed: Aug. 6, 1993

[30] Foreign Application Priority Data

| | | | |
|---|---|---|---|
| Aug. 7, 1992 | [JP] | Japan | 4-232864 |
| Sep. 29, 1992 | [JP] | Japan | 4-284035 |
| Nov. 25, 1992 | [JP] | Japan | 4-339815 |
| Nov. 30, 1992 | [JP] | Japan | 4-345421 |
| Nov. 30, 1992 | [JP] | Japan | 4-345424 |
| Nov. 30, 1992 | [JP] | Japan | 4-345426 |

[51] Int. Cl.[6] ..... G03G 5/047

[52] U.S. Cl. ..... 430/58; 430/56; 430/71; 430/75; 430/83

[58] Field of Search ..... 430/56, 57, 58, 430/75, 83

[56] References Cited

U.S. PATENT DOCUMENTS

| | | | |
|---|---|---|---|
| 4,106,934 | 8/1978 | Turnblonn | 430/58 |
| 5,213,924 | 5/1993 | Sakamoto | 430/58 |
| 5,278,013 | 1/1994 | Kashizaki et al. | 430/58 |

*Primary Examiner*—John Goodrow

*Attorney, Agent, or Firm*—Oblon, Spivak, McClelland, Maier & Neustadt

[57] ABSTRACT

A positively-chargeable single-layered type organic electrophotographic photoconductor composed of an electroconductive support and an organic single-layered photoconductive layer containing a charge generating material, an organic positive hole transporting material and an organic acceptor compound which are dispersed in a matrix binder agent, with the relationship of the oxidation potential ($E_{ox}$) of the charge generating material≦the oxidation potential ($E_{ox}$) of the organic positive hole transporting material being satisfied.

9 Claims, 1 Drawing Sheet

POSITIVELY-CHARGEABLE SINGLE-LAYERED TYPE ELECTROPHOTOGRAPHIC PHOTOCONDUCTOR

BACKGROUND OF THE INVENTION

1. Field of the Invention

The present invention relates to an organic electrophotographic photoconductor, and more particularly to an electrophotographic photoconductor comprising one photoconductive layer (hereinafter referred to as a single-layered type photoconductor) which is used with a positive charging process.

2. Discussion of Background

An electrophotographic process is employed to form a visible image from a latent electrostatic image. Therefore, it is necessary that an electrophotographic photoconductor for use with the electrophotographic process acquire sufficient chargeability in the dark and the surface potential of the photoconductor quickly decay by the application of light thereto. The above-mentioned characteristics of the photoconductor required on the electrophotographic process depend on the physical values of a photoconductive material for use in the photoconductor, such as high resistivity in the dark, excellent quantum efficiency and high electric charge mobility.

A photoconductor comprising an inorganic compound such as selenium, selenium - tellurium alloy or selenium arsenide, which is considered to meet the above-mentioned physical values, is conventionally employed in various kinds of copiers and printers. The inorganic photoconductor has, however, the drawbacks that those inorganic compounds are toxic, they must be handled with the utmost care because they are used in the amorphous state, and the manufacturing cost of the photoconductor is high because it is required to work each of the above-mentioned inorganic materials into a thin layer with a thickness of several ten μm by vacuum deposition. The inorganic photoconductors thus obtained do not satisfy all the requirements for the electrophotographic photoconductor.

To solve the above-mentioned problems, organic photoconductors (OPC) using organic materials have been actively developed and they are put to practical use. Most of the organic photoconductors in the practical use have a laminated structure, comprising a charge generation layer (CGL) capable of generating an electric charge and a charge transport layer (CTL) capable of transporting the electric charge, and are used with the negative charging process. Namely, the negatively chargeable laminated-type photoconductors comprising the CGL and the CTL are current in this field. The reasons for this are as follows:

(1) In a photoconductor comprising a single-layered photoconductive layer in which necessary components are merely dispersed, the fatigue in the chargeability, the photosensitivity and the electrostatic properties becomes apparent in the course of repeated operations and these characteristics deteriorate below the practical level. In the laminated-layered type photoconductor, on the other hand, the deterioration in the above-mentioned characteristics can be prevented to a great degree. Further, in the case of the laminated-layered photoconductor, sufficient mechanical durability can be imparted to the photoconductor by the provision of the CTL on the surface side of the photoconductor because the CTL has excellent mechanical strength and the thickness of the CTL can freely be controlled to some extent.

(2) An organic material with such a high electric charge mobility as to cope with the high-speed electrophotographic copying process is almost limited to a donor compound showing only the positive hole transporting characteristics. When the CTL comprising the above-mentioned donor compound is situated on the surface side of the photoconductor, the obtained photoconductor necessarily acquires a negative chargeability.

However, the above-mentioned function-separating laminated-type photoconductor with the negative chargeability has the following shortcomings:

(a) One of the shortcomings results from the negative chargeability of the photoconductor. The charging by use of corona discharge is so much reliable in the electrophotographic process that many copiers and printers employ the corona charging method. As is known, however, the corona discharge of negative polarity is unstable as compared with that of positive polarity. The scorotron is therefore used for negatively charging the photoconductor, which increases the running cost. Furthermore, generation of a large quantity of ozone accompanies the negative corona discharge. The copier or printer employing the negatively-chargeable photoconductor is equipped with an ozone filter to prevent the ozone from being discharged from the apparatus. This also causes the increase of the cost. The amount of ozone generated from the apparatus is originally small in the positive charging process.

In addition, the demand for a positively-chargeable photoconductor is increasing because when a two-component type developer prevailing in the field of electrophotography is used in combination with the positively-chargeable photoconductor, the images can be obtained steadily due to excellent environmental stability of the developer.

The negative chargeability of the above-mentioned function-separating laminated-type photoconductor restricts the electrophotographic processes. Such a photoconductor cannot flexibly cope with various kinds of electrophotographic development process. For example, a photoconductor which is positively and negatively chargeable can cope with both the positive and negative charging processes and achieve the composite electrophotographic development process using the positive and negative charging systems.

(b) The second shortcoming of the previously mentioned function-separating laminated-type photoconductor with the negative chargeability is derived from the photoconductive layer with a laminated structure. The photoconductive layer of an organic photoconductor can be prepared by solution coating, which can reduce the manufacturing cost as compared with the inorganic photoconductor which is prepared by vacuum deposition. To prepare the laminated-type organic photoconductor comprising the CGL and the CTL, however, an operation for solution coating is required at least twice. When an undercoat layer is provided between a support and a photoconductive layer to ensure the chargeability, it is necessary to repeat the operation for solution coating three times. The increase in the number of solution coating operations causes the rise of the manufacturing cost. In addition to the above, it is necessary to remarkably severely control the thickness of the CGL to such a degree that the thickness is less than 1 μm for the purpose of maintaining the balance between the photosensitivity and the mechanical durability of the photoconductor and obtaining excellent images. Severe control of the CGL thickness also becomes a factor in the increase of the manufacturing cost of the photoconductor.

With the above-mentioned shortcomings of the negatively-chargeable laminated-type photoconductor taken into consideration, it is understood that a single-layered organic photoconductor with positive chargeability is desirable in the electrophotographic process. Furthermore, if such a positively-chargeable photoconductor can be used in the negative charging process as it is or by making slight modification, the degree of freedom in the operating conditions can be increased at a low cost.

However, there are few organic photoconductors which can satisfy the above-mentioned requirements. At the present stage, examples of the single-layered organic photoconductor are almost limited to the followings: (1) a single-layered photoconductive layer comprising a charge transfer complex of polyvinylcarbazole serving as an electron donative material and trinitrofluorenone serving as an electron acceptable material; (2) a single-layered photoconductive layer comprising a eutectic complex of thiapyrylium dye and polycarbonate; and (3) a single-layered photoconductive layer in which a perylene pigment and a hydrazone compound are dispersed in a binder resin.

The above-mentioned conventional single-layered organic photoconductors (1) and (2) have the shortcomings that the sensitivity is so low that these photoconductors cannot endure the repeated operations, and a lot of ozone is generated because these photoconductors are used with the negative charging in the electrophotographic process. The single-layered organic photoconductor (3) is not suitable for high-speed copying process because of low photosensitivity.

Even though all the necessary components contained in a photoconductive layer with a laminated structure of the commercially available laminated-type photoconductor are merely dispersed in a single-layered photoconductive layer, the charging potential of the obtained photoconductor is not sufficiently high and the photosensitivity is not satisfactory. Further, the problem that the charging potential and the photosensitivity are unstable in the repeated copying operations remains unsolved.

When the single-layered organic photoconductor comprises a single-layered photoconductive layer which comprises a binder resin and a charge generating pigment dispersed in the binder resin, the charge generating pigment also serves as a charge transporting material. However, any pigments cannot satisfy the charge transporting characteristics of both a positive hole and an electron, so that the photosensitivity of the obtained photoconductor is low and the chargeability deteriorates in the repeated operations because of accumulation of the electric charges. In addition, there is an induction period in which the surface potential of the photoconductor does not decrease immediately after the photoconductor is exposed to light images, and therefore the latitude in the potential capable of forming a latent electrostatic images is small.

To improve the mobility of the positive hole in the above-mentioned conventional single-layered photoconductor, there is proposed a single-layered photoconductor comprising a single-layered photoconductive layer which further comprises a positive hole transporting material. In such a single-layered photoconductor, however, the problems that the chargeability is low and the charging potential drastically decreases in the course of repeated operations cannot be solved at the present stage.

SUMMARY OF THE INVENTION

Accordingly, an object of the present invention is to provide a positively-chargeable single-layered organic electrophotographic photoconductor with excellent chargeability and photosensitivity, capable of showing stable electrostatic characteristics in the repeated electrophotographic copying operations.

The above-mentioned object of the present invention can be achieved by a positively-chargeable single-layered organic photoconductor comprising an electroconductive support and an organic single-layered photoconductive layer comprising a charge generating material, an organic positive hole transporting material and an organic acceptor compound which are dispersed in a binder resin, with the relationship of the oxidation potential ($E_{ox}$) of the charge generating material≦the oxidation potential ($E_{ox}$) of the organic positive hole transporting material being satisfied.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein.

DETAILED DESCRIPTION OF THE PREFERRED EMBODIMENTS

Figure 1:
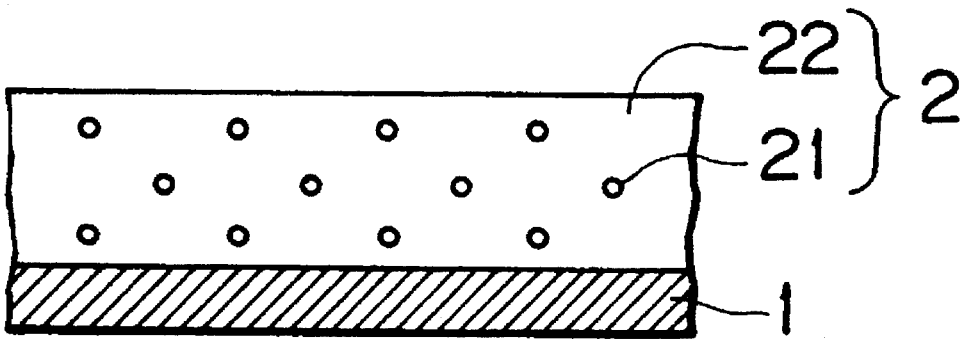
FIG. 1 is a schematic cross-sectional view of one embodiment of a positively-chargeable single-layered organic photoconductor according to the present invention.

FIG. 1 is a schematic cross-sectional view of one embodiment of a positively-chargeable single-layered type photoconductor of the present invention. A photoconductor shown in FIG. 1 comprises an electroconductive support 1 and a photoconductive layer 2 formed on the support 1. A charge generating material 21 is dispersed in a matrix binder agent 22 in the photoconductive layer 2, as shown in FIG. 1, and an organic positive hole transporting material and an organic acceptor compound are dispersed in the molecular state in the matrix binder agent 22.

The positively-chargeable single-layered electrophotographic photoconductor of the present invention has excellent chargeability and photosensitivity, so that it is suitable for low-speed and high-speed electrophotographic copying processes. The range of the spectral sensitivity of the photoconductor can be controlled by changing the kind of charge generating material contained in the photoconductive layer. Therefore, the single-layered photoconductor of the present invention can be placed in not only analogue copying apparatuses for obtaining monochromatic images and full-color images, but also page printers employing laser diode (LD) light for writing information.

In the single-layered photoconductor of the present invention, there is the relationship that the oxidation potential ($E_{ox}$) of the charge generating material≦the oxidation potential ($E_{ox}$) of the positive hole transporting material. When the above-mentioned relationship is satisfied in the single-layered photoconductive layer, sufficient chargeability can be ensured.

When the single-layered photoconductor of the present invention is positively charged, the charging potential of the photoconductor varies depending on the kind of positive hole transporting material. The charging potential is sufficiently high because the relationship that the oxidation potential ($E_{ox}$) of the charge generating material≦the oxidation potential ($E_{ox}$) of the positive hole transporting material is satisfied.

The main factors determining the charging potential of the photoconductor are the presence of the internal electric charge in the photoconductive layer and the degree of electron injection from an electrode support. The latter is related to the organic acceptor compound serving as a charge transporting material. The positive hole transporting material has an important effect on the decrease of the internal electric charge in the photoconductive layer. The above-mentioned internal electric charge is supposed to be present in the charge generating material in the photoconductive layer. The positive hole in the charge generating material can easily be injected into the positive hole transporting material without barrier when the above-mentioned relationship of the oxidation potential between the charge generating material and the positive hole transporting material is satisfied. The barrier against the injection of the positive hole in the charge generating material into the positive hole transporting material is remarkably low in the present invention, which results in the increase of the charging potential of the photoconductor.

In the single-layered photoconductive layer 2 of the photoconductor, it is necessary that the charge generating material 21 be uniformly dispersed in the matrix binder agent 22 and the organic positive hole transporting material be dispersed therein in the molecular state. The binder agent 22 also serves to determine the mechanical strength of the photoconductor required on the electrophotographic copying process.

The amount ratio of the binder agent 22 in the photoconductive layer 2 cannot be decreased without the consideration of the above-mentioned functions of the binder agent 22. It is preferable that the amount of the binder agent 22 be in the range of 30 to 90 wt. %, more preferably in the range of 40 to 70 wt. %, of the total weight of the photoconductive layer 2.

Examples of the binder agent 22 for use in the single-layered photoconductive layer 2 are addition polymerization type resins, polyaddition type resins, and polycondensation type resins, such as polyethylene, polypropylene, acrylic resin, methacrylic resin, vinyl chloride resin, vinyl acetate resin, epoxy resin, polyurethane resin, phenolic resin, polyester resin, alkyd resin, polycarbonate resin, silicone resin and melamine resin; and copolymers comprising the monomers employed in the above-mentioned resins, such as vinyl chloride - vinyl acetate copolymer resin and vinyl chloride - vinyl acetate - maleic anhydride copolymer resin.

In the present invention, the organic acceptor compound dispersed in the single-layered photoconductive layer 2 serves to decrease the residual surface potential and maintain the electrostatic characteristics of the photoconductor constant over a long period of time. The mechanism of the organic acceptor compound capable of achieving the above improvements has not been clarified, but it is supposed that a positive hole and an electron are generated in the charge generating material by the application of light thereto, and the electron is drawn from the charge generating material by the organic acceptor compound, thereby preventing the decrease of the electric resistivity of the charge generating material.

Another function of the organic acceptor compound is to raise the charging potential of the photoconductor at the charging step. Usually, at the charging step in the electrophotographic copying process, the charging of the photoconductor is broken off before the surface potential arrives at the highest level. Under such circumstances, the change in charging speed of the photoconductor has a serious effect on the charging potential of the photoconductor at the charging step. In the single-layered photoconductor according to the present invention, however, the charging potential of the photoconductor can be stabilized over repeated operations because the decrease in charging speed of the photoconductor can be prevented owing to the organic acceptor compound contained in the photoconductive layer 2. Examples of the organic acceptor compound for use in the single-layered photoconductive layer 2 include a quinone compound, a pi-electron compound having nitrile group, and a pi-electron compound having nitro group.

It is preferable that the amount of the organic acceptor compound be in the range of 1 to 40 wt. %, more preferably in the range of 5 to 40 wt. %, of the total weight of the photoconductive layer 2.

Examples of the organic positive hole transporting material are polymeric donor compounds such as a compound having a triphenylamine moiety in its molecule, a hydrazone compound, a triphenylmethane compound, an oxadiazole compound, a compound having a carbazole group, a pyrazoline compound, a styryl compound, a butadiene compound, a polysilane compound with a linear main chain comprising silicon atoms, and polyvinyl carbazole.

It is preferable that the amount of the organic positive hole transporting material be 15 wt. % or more, more preferably in the range of 20 to 50 wt. %, of the total weight of the photoconductive layer 2.

Examples of the charge generating material 21 for use in the photoconductive layer 2 are a bisazo pigment, a trisazo pigment, a phthalocyanine pigment, a quinacridone pigment, and an indigo pigment. In particular, the bisazo pigment and the trisazo pigment are preferred in the present invention.

It is preferable that the amount of the charge generating material 21 be in the range of 0.1 to 40 wt. %, more preferably in the range of 0.3 to 25 wt. %, of the total weight of the photoconductive layer 2.

It is desirable that the thickness of the single-layered photoconductive layer 2 for use in the present invention be in the range of 5 to 100 μm, more preferably in the range of 10 to 40 μm. Within the above range, the chargeability and the photosensitivity of the obtained photoconductor can be improved.

Examples of the electroconductive support 1 for use in the photoconductor of the present invention include a plate, drum or foil of metals such as aluminum, nickel, copper and stainless steel; and a plastic film or a glass plate on which aluminum, tin oxide, or copper iodide is deposited or coated.

In order to improve the chargeability of the photoconductor of the present invention, an undercoat layer may be interposed between the photoconductive layer 2 and the electroconductive support 1.

For preparing the undercoat layer, not only the same resins as used as the matrix binder agent 22 in the photoconductive layer 2, but also other resins such as polyamide resin, polyvinyl alcohol, casein, and polyvinyl pyrrolidone can be employed.

It is preferable that the thickness of the undercoat layer be in the range of 0.01 to 10 μm, more preferably in the range of 0.1 to 5 μm.

To prepare the single-layered organic electrophotographic photoconductor according to the present invention, a charge generating material, an organic positive hole transporting material, an organic acceptor compound, and a binder agent are dissolved in an organic solvent or dispersed in a ball mill or with the application of supersonic wave thereto to obtain a coating liquid for the photoconductive layer. The thus obtained coating liquid may be coated on the electroconductive support by dip coating, blade coating, or spray coating.

In the single-layered photoconductor of the present invention, it is preferable that the relationship of the reduction potential ($E_{red}$) of the charge generating material≦the reduction potential ($E_{red}$) of the organic acceptor compound be satisfied.

To satisfy the aforementioned relationship of the oxidation potential of the charge generating material≦ the oxidation potential of the positive hole transporting material, a p-type (positive-type) charge generating pigment is preferably used as the charge generating material in the present invention. In such a charge generating material, the mobility of an electron is considerably smaller than that of a positive hole.

Since the organic acceptor compound is dispersed in the single-layered photoconductive layer of the photoconductor according to the present invention, the electron generated in the charge generating material can be injected into the organic acceptor compound. This prevents the accumulation of electron in the charge generating material, causing the improvements in the photosensitivity and the repetition properties of the photoconductor. The electron transporting efficiency of the p-type charge generating material is poor, so that it is considered that the density of free electrons in the p-type charge generating material is originally to such a degree that the charging potential of the photoconductor is not drastically decreased. Accordingly, it is preferable that the relationship of the reduction potential ($E_{red}$) Of the charge generating material≦the reduction potential ($E_{red}$) of the organic acceptor compound be satisfied, because the electron in the charge generating material can easily be injected into the organic acceptor compound.

In the present invention, when a charge generating material of which oxidation potential ($E_{ox}$) is not more than that of the positive hole transporting material, and of which reduction potential ($E_{red}$) is not more than that of the organic acceptor compound is employed in the single-layered photoconductor of the present invention, the chargeability, the photosensitivity and the electrostatic characteristics can be stabilized in the course of repeated operations.

When the above-mentioned relationships are taken into consideration, a p-type azo pigment is preferably used in the present invention as the charge generating material 21 in the single-layered photoconductive layer 2. The chargeability and the photosensitivity of the single-layered photoconductor comprising a p-type azo pigment as the charge generating material are excellent. This kind of photoconductor is available with both the positive charging and negative charging systems, and therefore, it is applicable to low-speed and high-speed electrophotographic copying processes. The range of the spectral sensitivity of the photoconductor can be controlled by changing the kind of p-type azo pigment serving as the charge generating material or using two or more kinds of p-type azo pigments in combination. The p-type azo pigment for use in the single-layered photoconductive layer is defined as an azo pigment in which the carrier of electric charge is mainly a positive hole. Identification of the p-type azo pigment is carried out in such a manner that a pigment is dispersed in a resin in an amount of as high as about 50 wt. % to prepare a photoconductive layer, and the photoconductor thus prepared is positively and negatively charged. Thereafter, the monochromatic light with a wavelength approximate to the maximum absorption band of the particle of the above-mentioned pigment is applied to the photoconductor. The p-type azo pigment is identified when the photosensitivity of the photoconductor is higher in the positive charging step than in the negative charging step. The mobility of the positive hole within a particle of the p-type azo pigment and from one particle to the other, and the lifetime of the positive hole are superior to those of the electron in the p-type azo pigment.

The advantage of the use of the p-type azo pigment as the charge generating material in the single-layered photoconductor of the present invention is that the charge generating capability of the azo pigment is excellent when the charged photoconductor is exposed to light. Although it is believed that the charge transporting capability of the azo pigment is inferior to, for example, that of a phthalocyanine pigment, the charge generating capability of the azo pigment can be further improved by modification of the chemical structure of the azo pigment. Therefore, the azo pigment is conventionally used as a charge generating material in the charge generation layer (CGL) of the function-separating laminated-type photoconductor. In the single-layered photoconductor of the present invention, high photosensitivity can be obtained without decreasing the charge generating capability of the p-type azo pigment. This is because the organic positive hole transporting material is dispersed in the single-layered photoconductive layer. In addition, the light absorption characteristics of the p-type azo pigment can be changed by the modification of the chemical structure of the azo pigment, so that the desired spectral sensitivity can be obtained with no difficulty.

As the p-type azo pigment serving as a charge generating material 21 in the single-layered photoconductive layer 2, a bisazo pigment and a trisazo pigment are preferred in the present invention. Moreover, it is preferable that a diazo moiety of the bisazo pigment and the trisazo pigment have an electron-donor group such as phenyl group, biphenyl group, t-phenyl group, stilbene group, styrylstilbene group, carbazole group, ethylcarbazole group, dibenzofuran group, dibenzothiophene group, oxadiazole group, diphenylamine group, or triphenylamine group from the viewpoint of the effect in decreasing the oxidation potential of the p-type azo pigment.

A preferable example of the p-type azo pigment is a trisazo compound of the following formula (1):

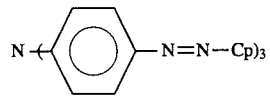

(1)

wherein Cp represents a coupler radical.

Another preferable example of the p-type azo pigment used as the charge generating material in the single-layered photoconductor of the present invention is a disazo compound of the following formula (2):

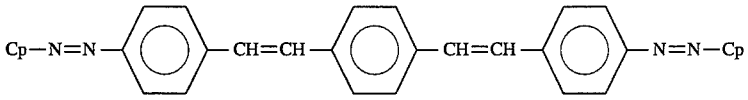

(2)

wherein Cp represents a coupler radical.

A further preferable example of the p-type azo pigment in the single-layered photoconductor of the present invention is a disazo compound of the following formula (3):

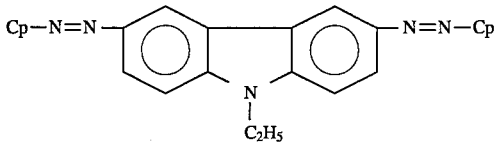

(3)

wherein Cp represents a coupler radical.

The coupler radical represented by Cp in the azo compounds of formulas (1) to (3) may be chosen from the conventional coupler components. A preferable coupler radical for use in the present invention is represented by the following formula (4):

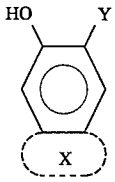

(4)

(wherein X represents a cyclic hydrocarbon group which may have a substituent or a heterocyclic group which may have a substituent; and Y represents —CON($R^1$)($R^2$) in which $R^1$ and $R^2$ independently represent hydrogen, a cyclic hydrocarbon group which may have a substituent, or a heterocyclic group which may have a substituent, and $R^1$ and $R^2$ may form a ring in combination).

Specific examples of $R^1$ or $R^2$ in the coupler radical represented by formula (4) are an alkyl group such as methyl group, ethyl group, propyl group or butyl group; an aromatic hydrocarbon group such as phenyl group or naphthyl group; and an aromatic heterocyclic group such as pyridyl group, carbazolyl group or benzotriazole group.

Specific examples of the substituent of the aromatic hydrocarbon group or the aromatic heterocyclic group represented by $R^1$ or $R^2$ in the coupler radical of formula (4) are an alkyl group such as methyl group, ethyl group, propyl group or butyl group; a halogenated alkyl group such as trifluoromethyl group; a halogen atom such as chlorine, bromine, or iodine; a substituted hydroxyl group such as methoxy group, ethoxy group, propoxy group or butoxy group; a substituted amino group such as methylamino group, ethylamino group, dimethylamino group, diethylamino group, phenylamino group or diphenylamino group; nitro group; cyano group; hydroxyl group; and amino group.

The trisazo compound represented by formula (1) can be prepared by a conventionally known method.

For example, the trisazo compound of formula (1) can easily be prepared by subjecting a triamino compound of formula (5) to diazotation by a conventional method, followed by coupling reaction with a coupler in the presence of an alkali.

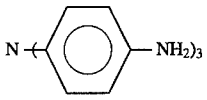

(5)

Alternatively, the trisazo compound of formula (1) can also be prepared by subjecting the triamino compound of formula (5) to diazotation to obtain a hexazonium salt. Thereafter, the hexazonium salt is isolated as a salt of borofluoric acid or a zinc salt, and allowed to react with a coupler in the presence of an alkali in an appropriate organic inactive solvent such as N,N-dimethylformamide or dimethylsulfoxide.

Specific examples of the trisazo compound of formula (1) used as the charge generating material in the present invention are shown in the following Table 1.

TABLE 1-(1)

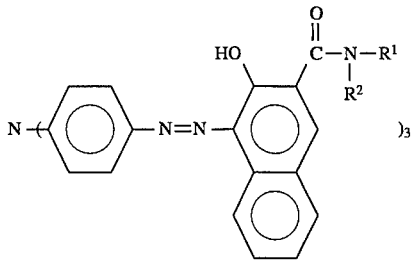

| No. | $R^1$ | $R^2$ |
|---|---|---|
| 1 | —H | 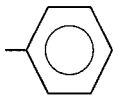 |
| 2 | —$CH_3$ | 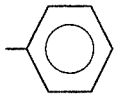 |
| 3 | —H | 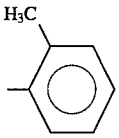  |
| 4 | —H | 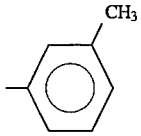  |
| 5 | —H | 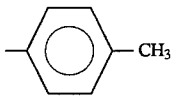  |

TABLE 1-(1)-continued
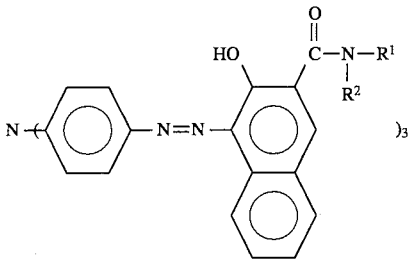
| No. | $R^1$ | $R^2$ |
|---|---|---|
| 6 | −H | 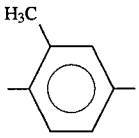 |
| 7 | −H | 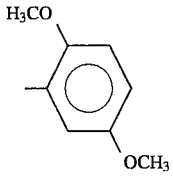 |
| 8 | −H | 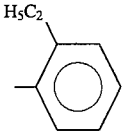 |
| 9 | −H | 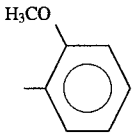 |
| 10 | −H | 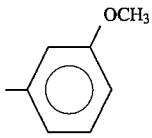 |
| 11 | −H | 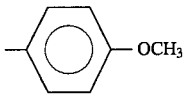 |
| 12 | −H | 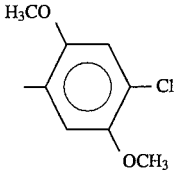 |
| 13 | −H | 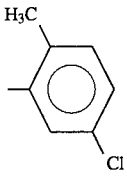 |
TABLE 1-(1)-continued
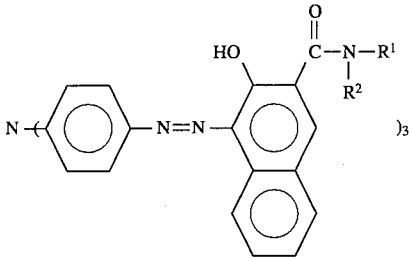
| No. | $R^1$ | $R^2$ |
|---|---|---|
| 14 | −H | 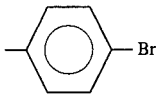 |
| 15 | −H | 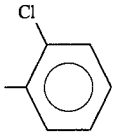 |
| 16 | −H | 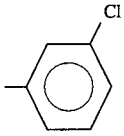 |
| 17 | −H | 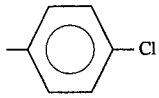 |
| 18 | −H | 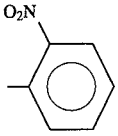 |
| 19 | −H | 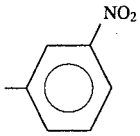 |
| 20 | −H | 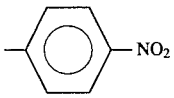 |
| 21 | −H | 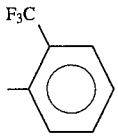 |
| 22 | −H | 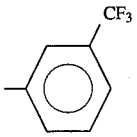 |
| 23 | −H | 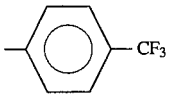 |

TABLE 1-(1)-continued
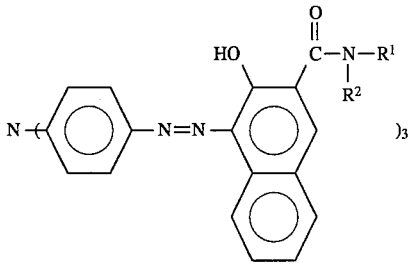
| No. | $R^1$ | $R^2$ |
|---|---|---|
| 24 | −H | 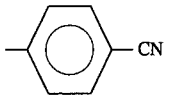 |
| 25 | −H | 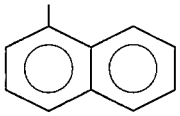 |
| 26 | −H | 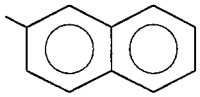 |
TABLE 1-(2)
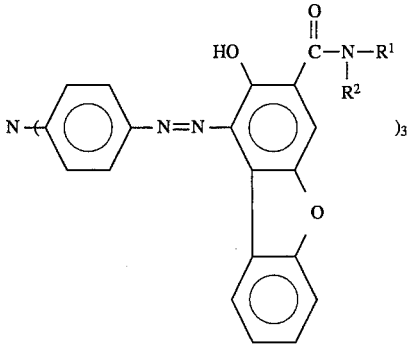
| No. | $R^1$ | $R^2$ |
|---|---|---|
| 27 | −H | 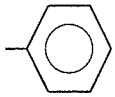 |
| 28 | $-CH_3$ | 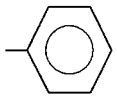 |
| 29 | −H | 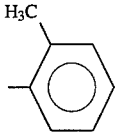 |
TABLE 1-(2)-continued
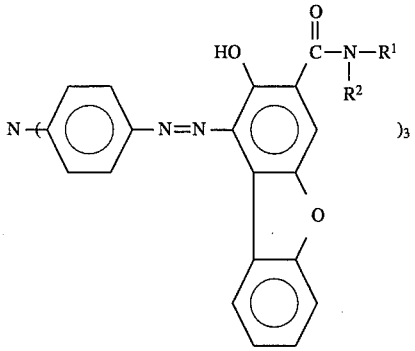
| No. | $R^1$ | $R^2$ |
|---|---|---|
| 30 | −H | 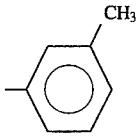 |
| 31 | −H | 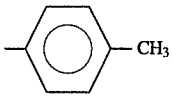 |
| 32 | −H | 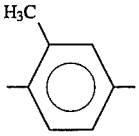 |
| 33 | −H | 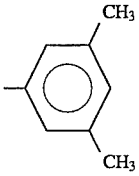 |
| 34 | −H | 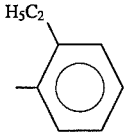 |
| 35 | −H | 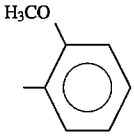 |
| 36 | −H | 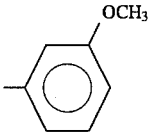 |
| 37 | −H | 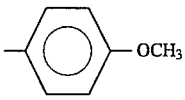 |

TABLE 1-(2)-continued
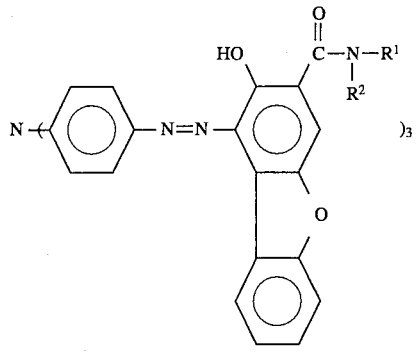
| No. | $R^1$ | $R^2$ |
|---|---|---|
| 38 | −H | 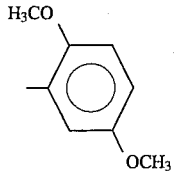 |
| 39 | −H | 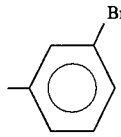 |
| 40 | −H | 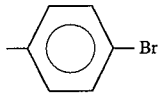 |
| 41 | −H | 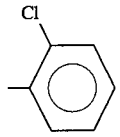 |
| 42 | −H | 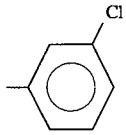 |
| 43 | −H | 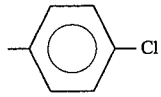 |
| 44 | −H | 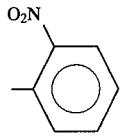 |
| 45 | −H | 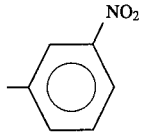 |
TABLE 1-(2)-continued
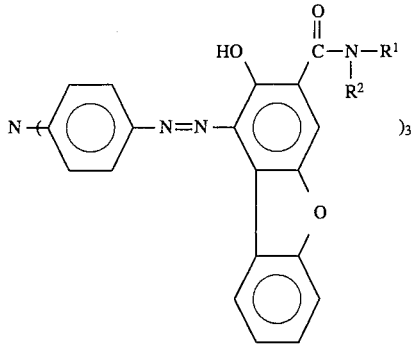
| No. | $R^1$ | $R^2$ |
|---|---|---|
| 46 | −H | 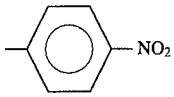 |
| 47 | −H | 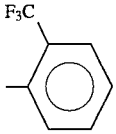 |
| 48 | −H | 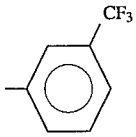 |
| 49 | −H | 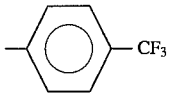 |
| 50 | −H | 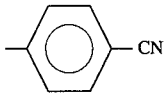 |
| 51 | −H | 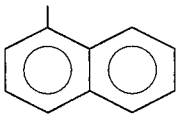 |
| 52 | −H | 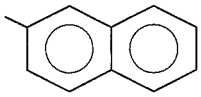 |

TABLE 1-(3)
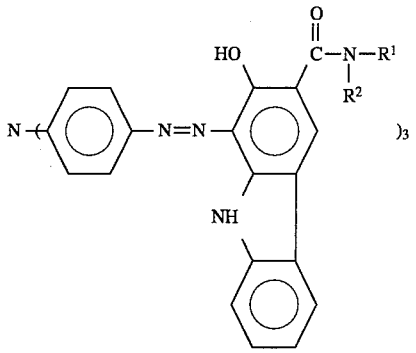
| No. | $R^1$ | $R^2$ |
|---|---|---|
| 53 | −H | 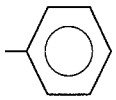 |
| 54 | $-CH_3$ | 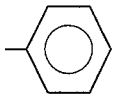 |
| 55 | −H | 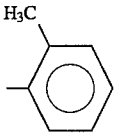 |
| 56 | −H | 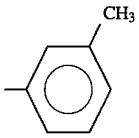 |
| 57 | −H | 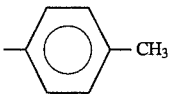 |
| 58 | −H | 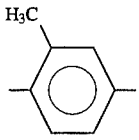 |
| 59 | −H | 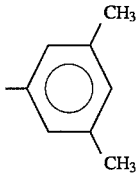 |
| 60 | −H | 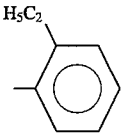 |
| 61 | −H | 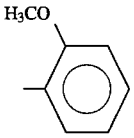 |
TABLE 1-(3)-continued
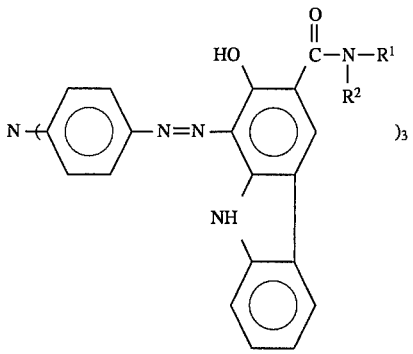
| No. | $R^1$ | $R^2$ |
|---|---|---|
| 62 | −H | 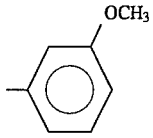 |
| 63 | −H | 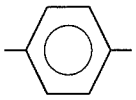 |
| 64 | −H | 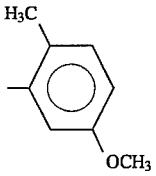 |
| 65 | −H | 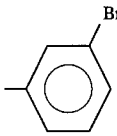 |
| 66 | −H | 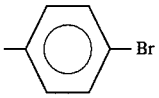 |
| 67 | −H | 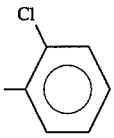 |
| 68 | −H | 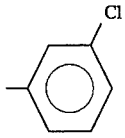 |
| 69 | −H | 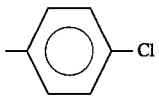 |
| 70 | −H | 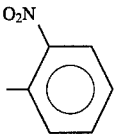 |

TABLE 1-(3)-continued
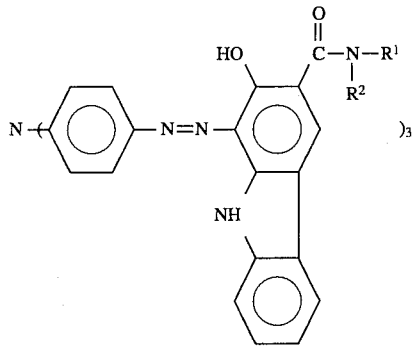
| No. | $R^1$ | $R^2$ |
|---|---|---|
| 71 | −H | 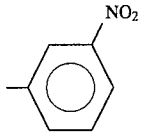 |
| 72 | −H | 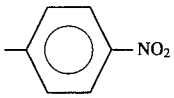 |
| 73 | −H | 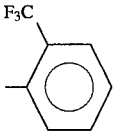 |
| 74 | −H | 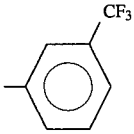 |
| 75 | −H | 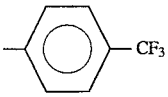 |
| 76 | −H | 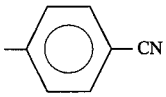 |
| 77 | −H | 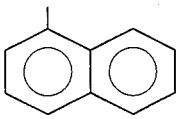 |
| 78 | −H | 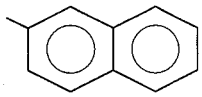 |
TABLE 1-(4)
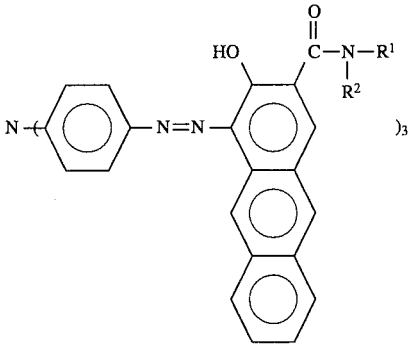
| No. | $R^1$ | $R^2$ |
|---|---|---|
| 79 | −H | 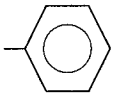 |
| 80 | $-CH_3$ | 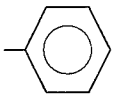 |
| 81 | −H | 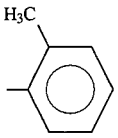 |
| 82 | −H | 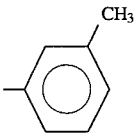 |
| 83 | −H | 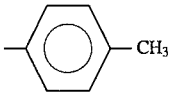 |
| 84 | −H | 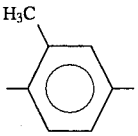 |
| 85 | −H | 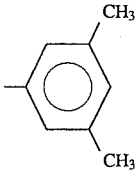 |
| 86 | −H | 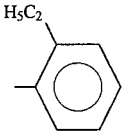 |
| 87 | −H | 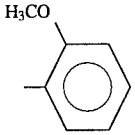 |

TABLE 1-(4)-continued
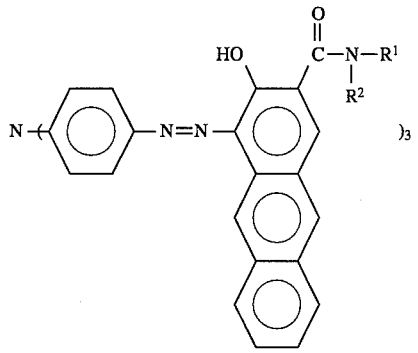
| No. | $R^1$ | $R^2$ |
|---|---|---|
| 88 | −H | 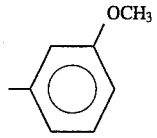 |
| 89 | −H | 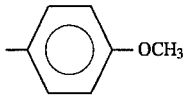 |
| 90 | −H | 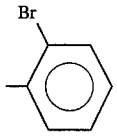 |
| 91 | −H | 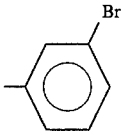 |
| 92 | −H | 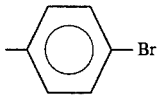 |
| 93 | −H | 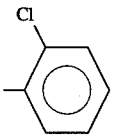 |
| 94 | −H | 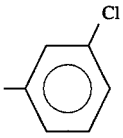 |
| 95 | −H | 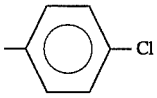 |
| 96 | −H | 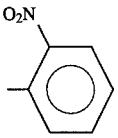 |
TABLE 1-(4)-continued
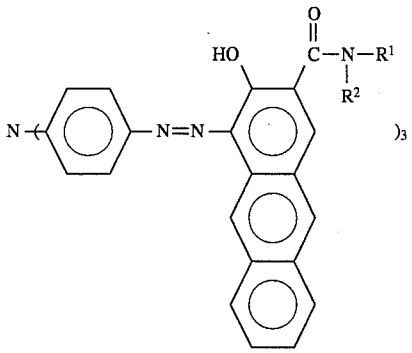
| No. | $R^1$ | $R^2$ |
|---|---|---|
| 97 | −H | 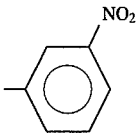 |
| 98 | −H | 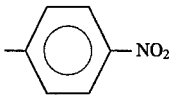 |
| 99 | −H | 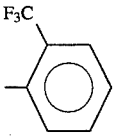 |
| 100 | −H | 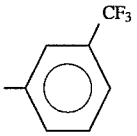 |
| 101 | −H | 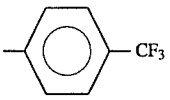 |
| 102 | −H | 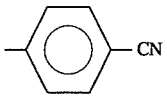 |
| 103 | −H | 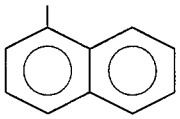 |
| 104 | −H | 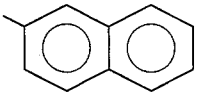 |

TABLE 1-(5)
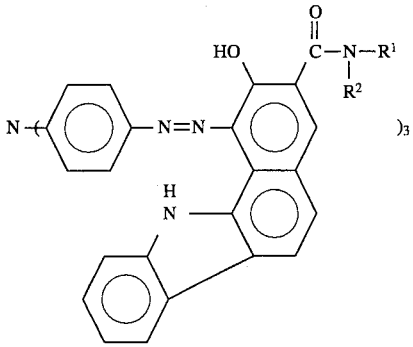
| No. | $R^1$ | $R^2$ |
|---|---|---|
| 105 | $-H$ | 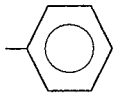 |
| 106 | $-CH_3$ | 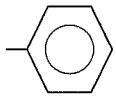 |
| 107 | $-H$ | 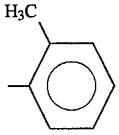 |
| 108 | $-H$ | 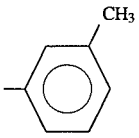 |
| 109 | $-H$ | 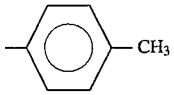 |
| 110 | $-H$ | 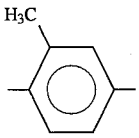 |
| 111 | $-H$ | 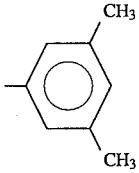 |
| 112 | $-H$ | 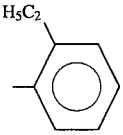 |
| 113 | $-H$ | 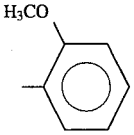 |
TABLE 1-(5)-continued
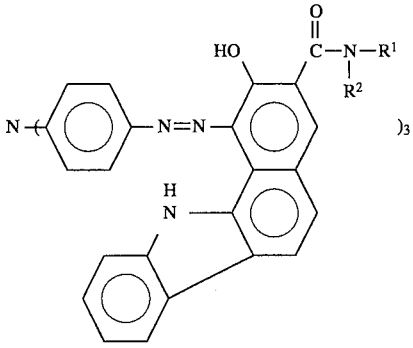
| No. | $R^1$ | $R^2$ |
|---|---|---|
| 114 | $-H$ | 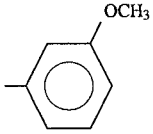 |
| 115 | $-H$ | 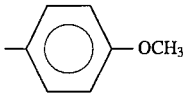 |
| 116 | $-H$ | 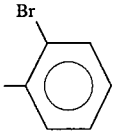 |
| 117 | $-H$ | 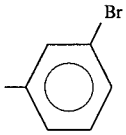 |
| 118 | $-H$ | 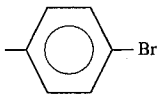 |
| 119 | $-H$ | 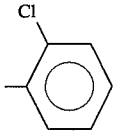 |
| 120 | $-H$ | 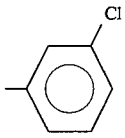 |
| 121 | $-H$ | 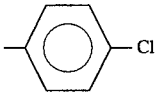 |
| 122 | $-H$ | 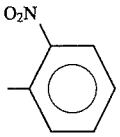 |

TABLE 1-(5)-continued
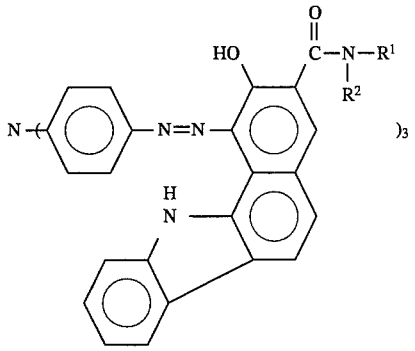
| No. | $R^1$ | $R^2$ |
|---|---|---|
| 123 | −H | 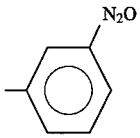 |
| 124 | −H | 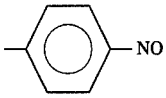 |
| 125 | −H | 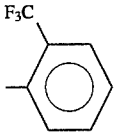 |
| 126 | −H | 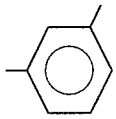 |
| 127 | −H | 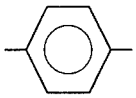 |
| 128 | −H | 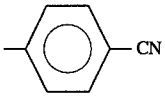 |
| 129 | −H | 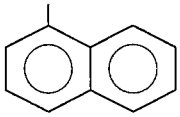 |
| 130 | −H | 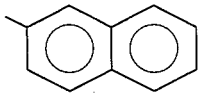 |
TABLE 1-(6)
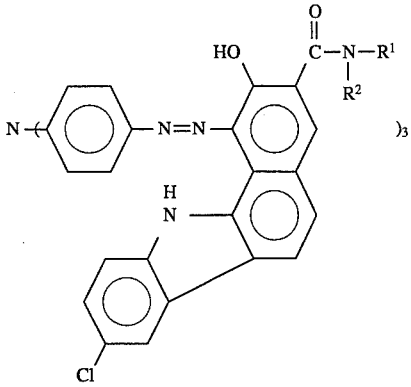
| No. | $R^1$ | $R^2$ |
|---|---|---|
| 131 | −H | 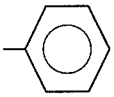 |
| 132 | $-CH_3$ | 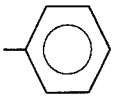 |
| 133 | −H | 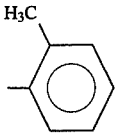 |
| 134 | −H | 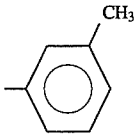 |
| 135 | −H | 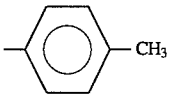 |
| 136 | −H | 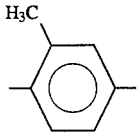 |
| 137 | −H | 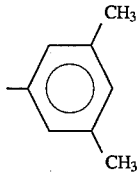 |
| 138 | −H | 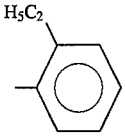 |

TABLE 1-(6)-continued
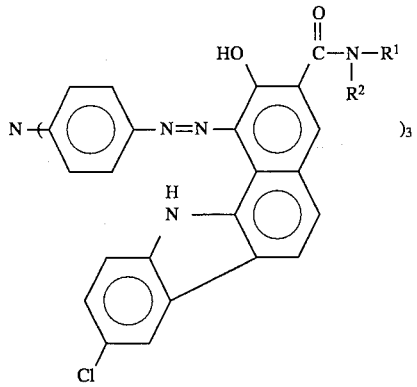
| No. | $R^1$ | $R^2$ |
|---|---|---|
| 139 | −H | 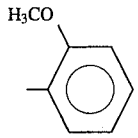 |
| 140 | −H | 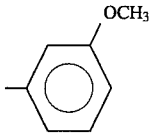 |
| 141 | −H | 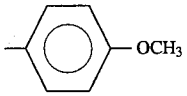 |
| 142 | −H | 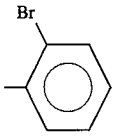 |
| 143 | −H | 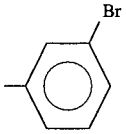 |
| 144 | −H | 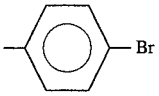 |
| 145 | −H | 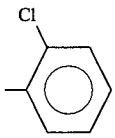 |
| 146 | −H | 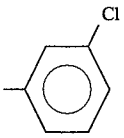 |
| 147 | −H | 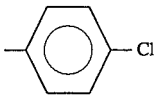 |
TABLE 1-(6)-continued
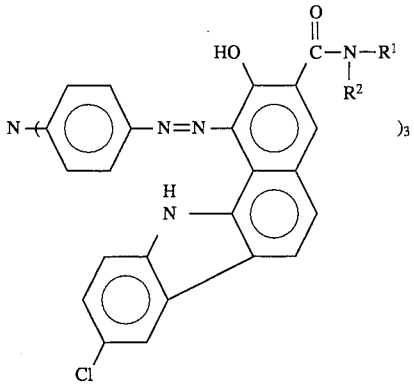
| No. | $R^1$ | $R^2$ |
|---|---|---|
| 148 | −H | 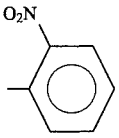 |
| 149 | −H | 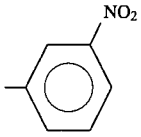 |
| 150 | −H | 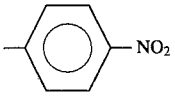 |
| 151 | −H | 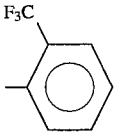 |
| 152 | −H | 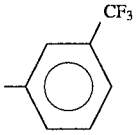 |
| 153 | −H | 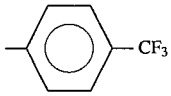 |
| 154 | −H | 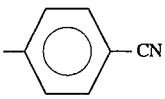 |
| 155 | −H | 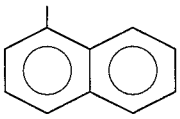 |
| 156 | −H | 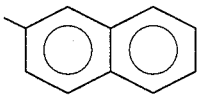 |
The disazo compound represented by formula (2) can also be prepared by a conventionally known method.

For instance, a diamino compound of formula (6) is subjected to diazotation by a conventional method, followed by coupling reaction with a coupler in the presence of an alkali. Alternatively, the diamino compound of formula (6) is subjected to diazotation to obtain a tetrazonium salt. Thereafter, the tetrazonium salt is isolated as a salt of borofluoric acid or a zinc salt, and allowed to react with a coupler in the presence of an alkali in an appropriate organic inactive solvent such as N,N-dimethylformamide or dimethylsulfoxide.

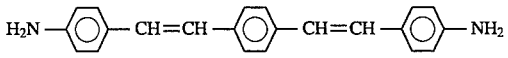

(6)

Specific examples of the disazo compound of formula (2) used as the charge generating material in the present invention are shown in the following Table 2.

TABLE 2-(1)

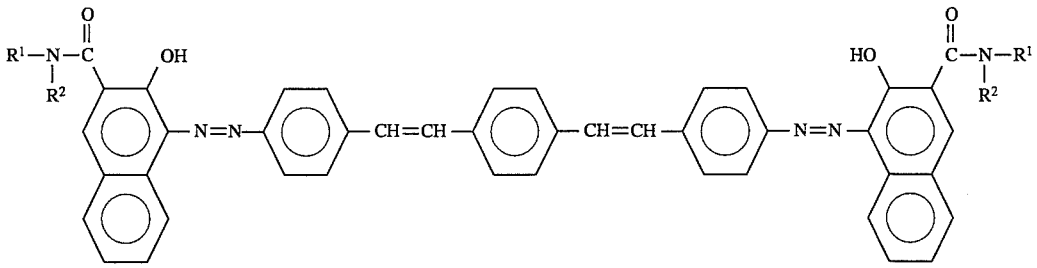

| No. | $R^1$ | $R^2$ |
|---|---|---|
| 1 | −H | 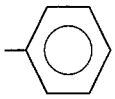 |
| 2 | $-CH_3$ | 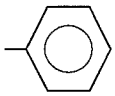 |
| 3 | −H | 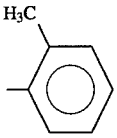 |
| 4 | −H | 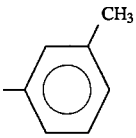 |
| 5 | −H | 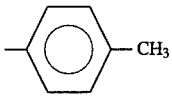 |
| 6 | −H | 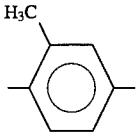 |
| 7 | −H | 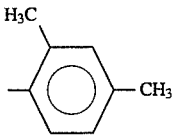 |
| 8 | −H | 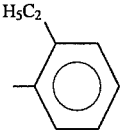 |

TABLE 2-(1)-continued
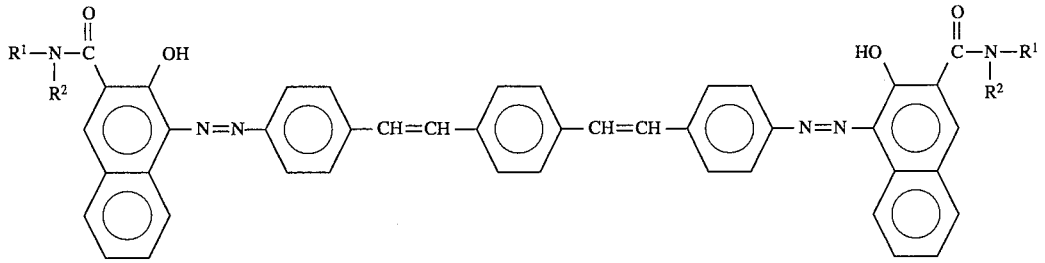
| No. | $R^1$ | $R^2$ |
|---|---|---|
| 9 | −H | 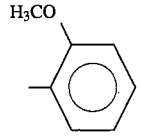 |
| 10 | −H | 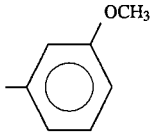 |
| 11 | −H | 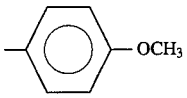 |
| 12 | −H | 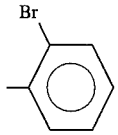 |
| 13 | −H | 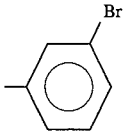 |
| 14 | −H | 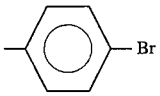 |
| 15 | −H | 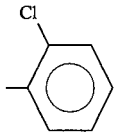 |
| 16 | −H | 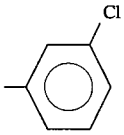 |
| 17 | −H | 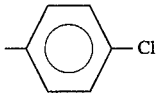 |
| 18 | −H | 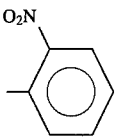 |

TABLE 2-(1)-continued
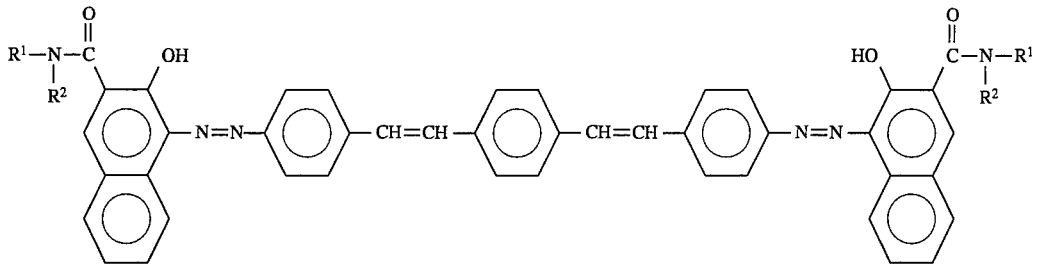
| No. | $R^1$ | $R^2$ |
|---|---|---|
| 19 | −H | 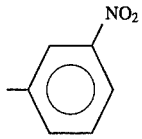 |
| 20 | −H | 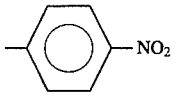 |
| 21 | −H | 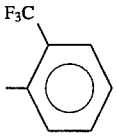 |
| 22 | −H | 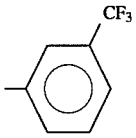 |
| 23 | −H | 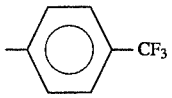 |
| 24 | −H | 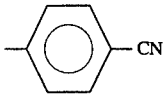 |
| 25 | −H | 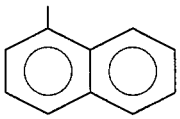 |
| 26 | −H | 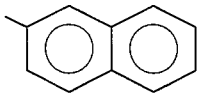 |
| 27 | −H | 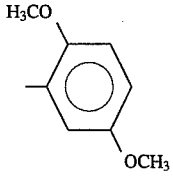 |

TABLE 2-(1)-continued
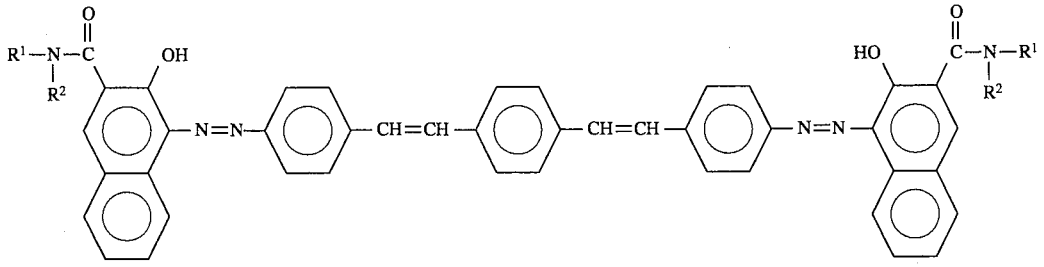
| No. | $R^1$ | $R^2$ |
|---|---|---|
| 28 | $-H$ | 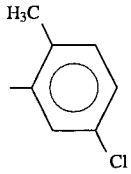 |
| 29 | $-H$ | 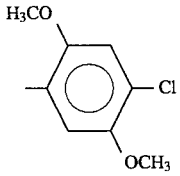 |
| 30 | $-H$ | 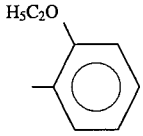 |
TABLE 2-(2)
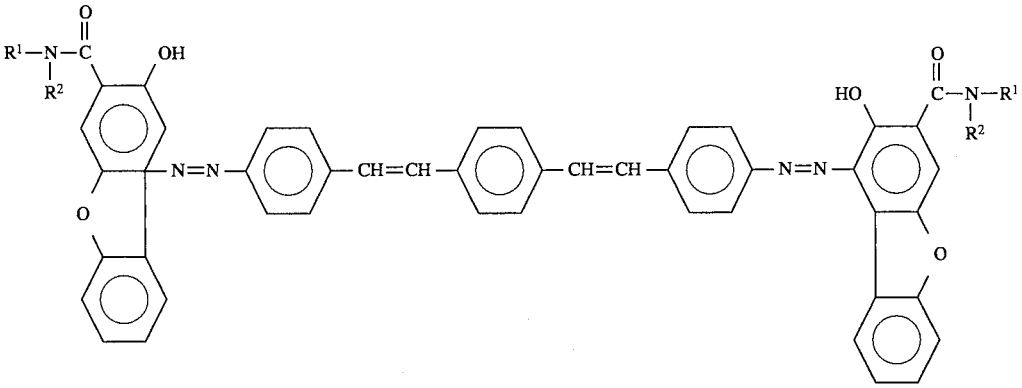
| No. | $R^1$ | $R^2$ |
|---|---|---|
| 31 | $-H$ | 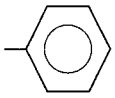 |
| 32 | $-CH_3$ | 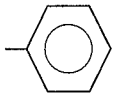 |

TABLE 2-(2)-continued
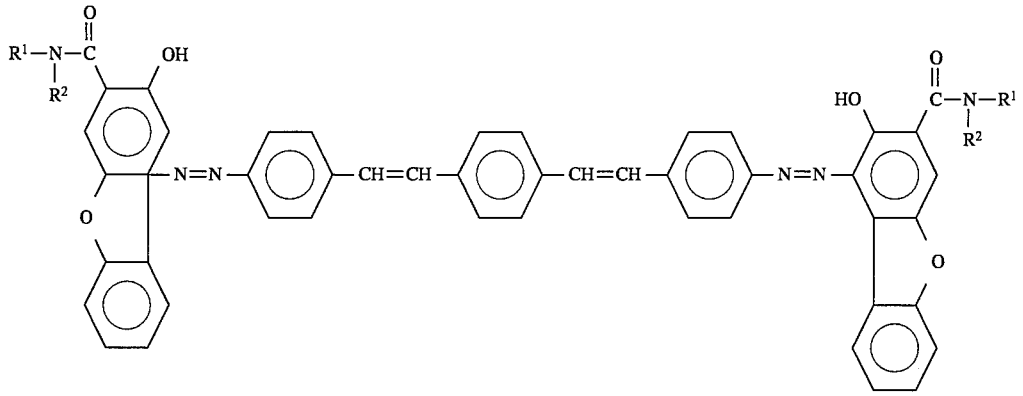
| No. | $R^1$ | $R^2$ |
|---|---|---|
| 33 | −H | 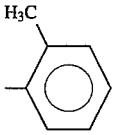 |
| 34 | −H | 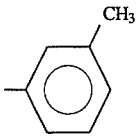 |
| 35 | −H | 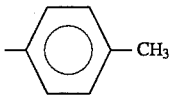 |
| 36 | −H | 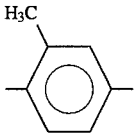 |
| 37 | −H | 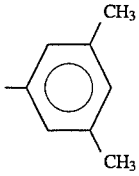 |
| 38 | −H | 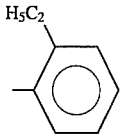 |
| 39 | −H | 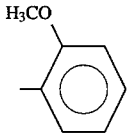 |
| 40 | −H | 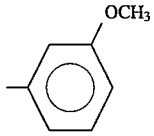 |

TABLE 2-(2)-continued
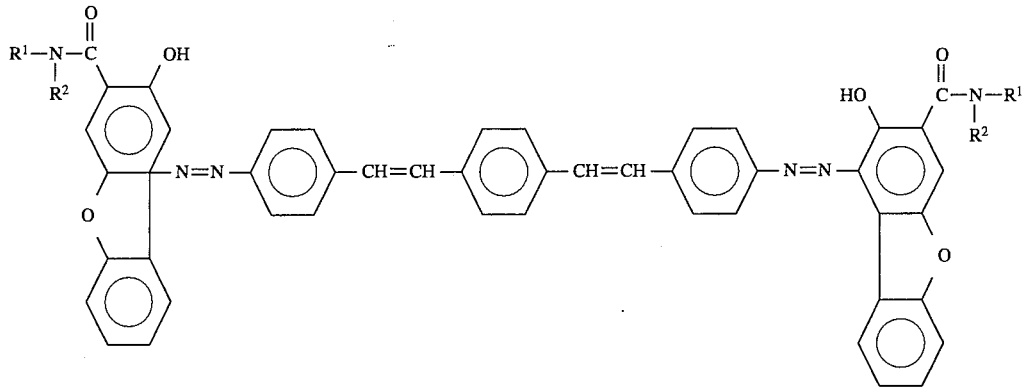
| No. | $R^1$ | $R^2$ |
|---|---|---|
| 41 | −H | 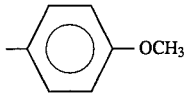 |
| 42 | −H | 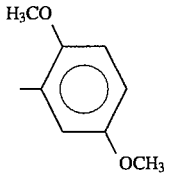 |
| 43 | −H | 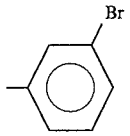 |
| 44 | −H | 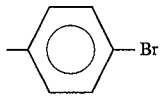 |
| 45 | −H | 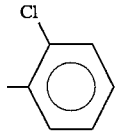 |
| 46 | −H | 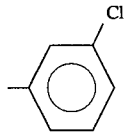 |
| 47 | −H | 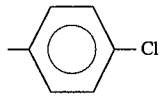 |
| 48 | −H | 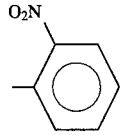 |

TABLE 2-(2)-continued
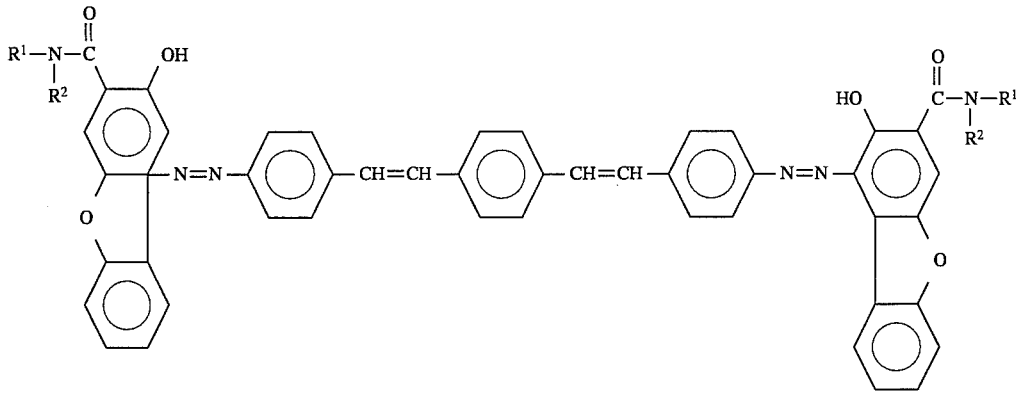
| No. | $R^1$ | $R^2$ |
|---|---|---|
| 49 | −H | 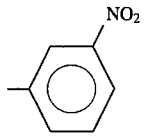 |
| 50 | −H | 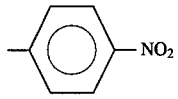 |
| 51 | −H | 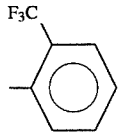 |
| 52 | −H | 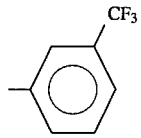 |
| 53 | −H | 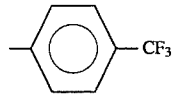 |
| 54 | −H | 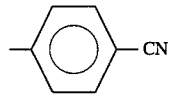 |
| 55 | −H | 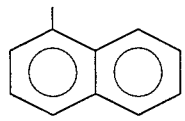 |
| 56 | −H | 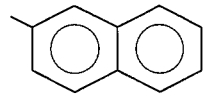 |

TABLE 2-(3)
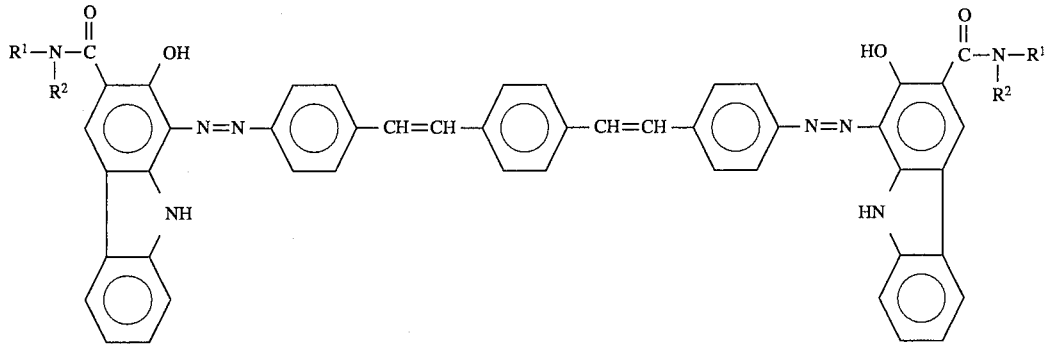
| No. | $R^1$ | $R^2$ |
|---|---|---|
| 57 | −H | 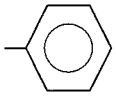 |
| 58 | $-CH_3$ | 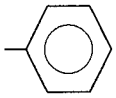 |
| 59 | −H | 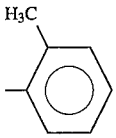 |
| 60 | −H | 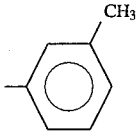 |
| 61 | −H | 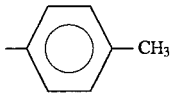 |
| 62 | −H | 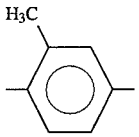 |
| 63 | −H | 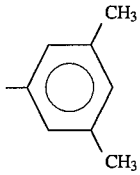 |
| 64 | −H | 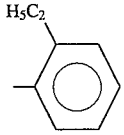 |
| 65 | −H | 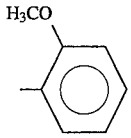 |

TABLE 2-(3)-continued
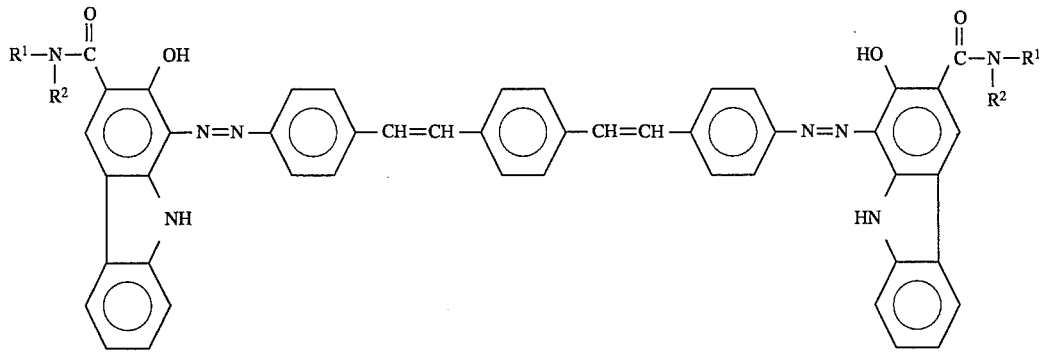
| No. | $R^1$ | $R^2$ |
|---|---|---|
| 66 | −H | 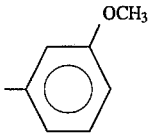 |
| 67 | −H | 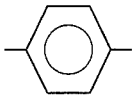 |
| 68 | −H | 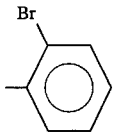 |
| 69 | −H | 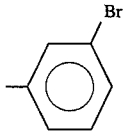 |
| 70 | −H | 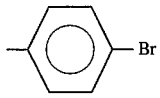 |
| 71 | −H | 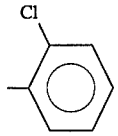 |
| 72 | −H | 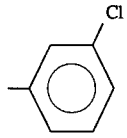 |
| 73 | −H | 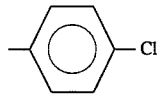 |
| 74 | −H | 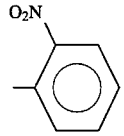 |

TABLE 2-(3)-continued
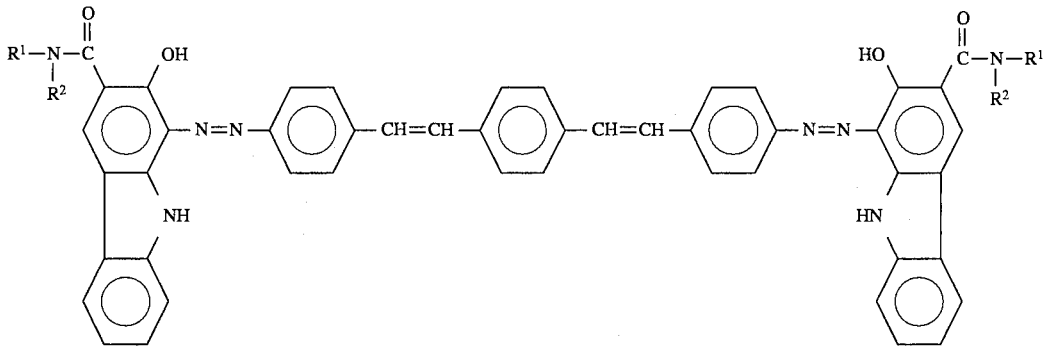
| No. | $R^1$ | $R^2$ |
|---|---|---|
| 75 | −H | 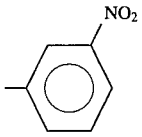 |
| 76 | −H | 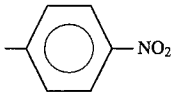 |
| 77 | −H | 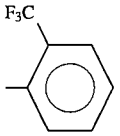 |
| 78 | −H | 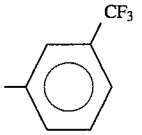 |
| 79 | −H | 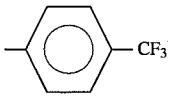 |
| 80 | −H | 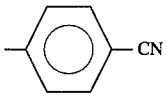 |
| 81 | −H | 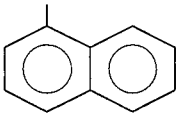 |
| 82 | −H | 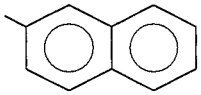 |

TABLE 2-(4)
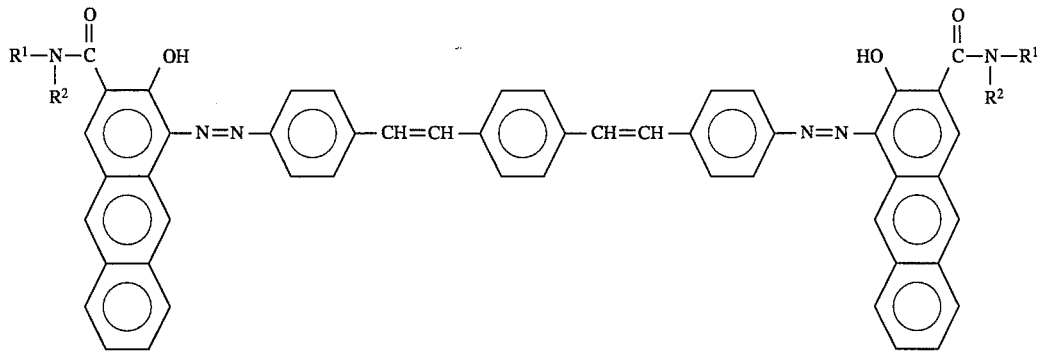
| No. | $R^1$ | $R^2$ |
|---|---|---|
| 83 | $-H$ | 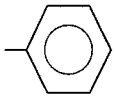 |
| 84 | $-CH_3$ | 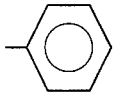 |
| 85 | $-H$ | 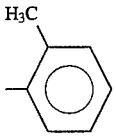 |
| 86 | $-H$ | 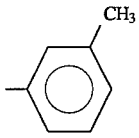 |
| 87 | $-H$ | 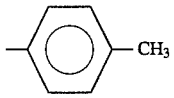 |
| 88 | $-H$ | 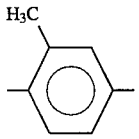 |
| 89 | $-H$ | 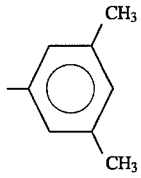 |
| 90 | $-H$ | 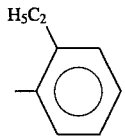 |
| 91 | $-H$ | 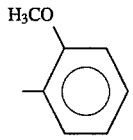 |

TABLE 2-(4)-continued
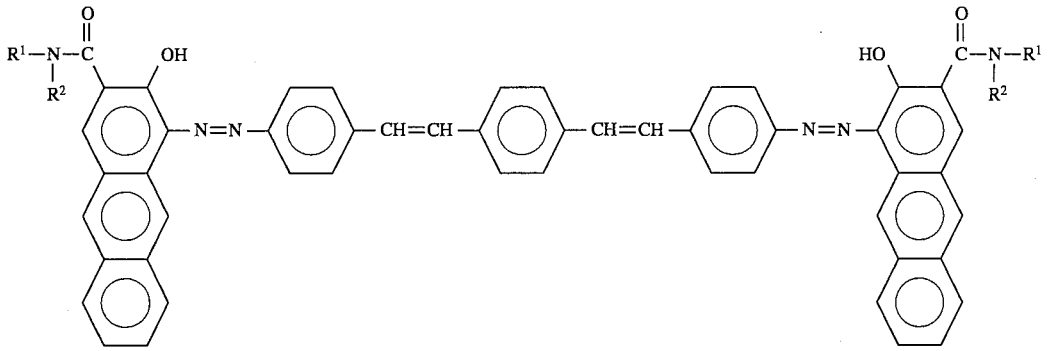
| No. | $R^1$ | $R^2$ |
|---|---|---|
| 92 | −H | 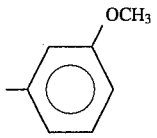 |
| 93 | −H | 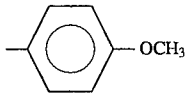 |
| 94 | −H | 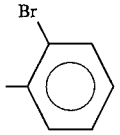 |
| 95 | −H | 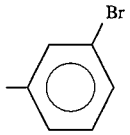 |
| 96 | −H | 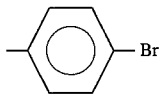 |
| 97 | −H | 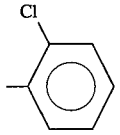 |
| 98 | −H | 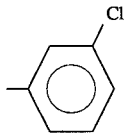 |
| 99 | −H | 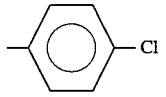 |
| 100 | −H | 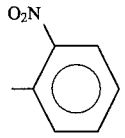 |

TABLE 2-(4)-continued
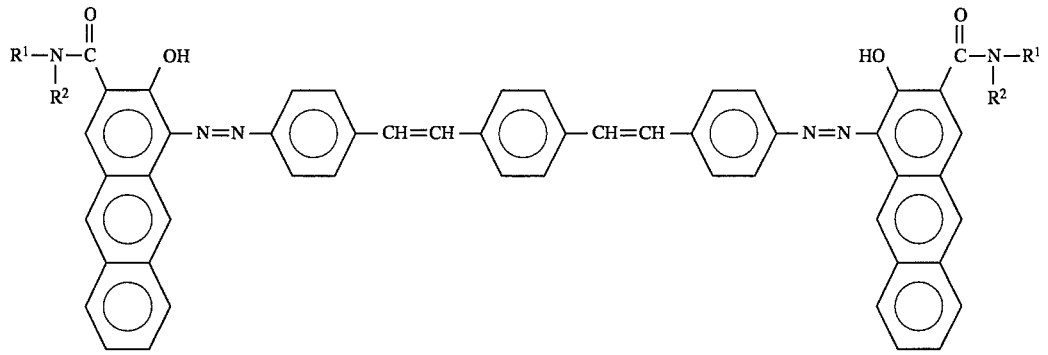
| No. | $R^1$ | $R^2$ |
|---|---|---|
| 101 | −H | 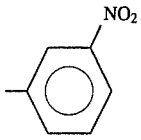 |
| 102 | −H | 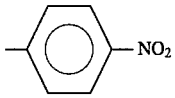 |
| 103 | −H | 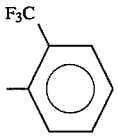 |
| 104 | −H | 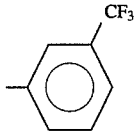 |
| 105 | −H | 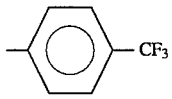 |
| 106 | −H | 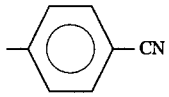 |
| 107 | −H | 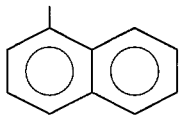 |
| 108 | −H | 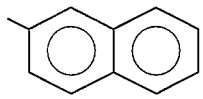 |

TABLE 2-(5)
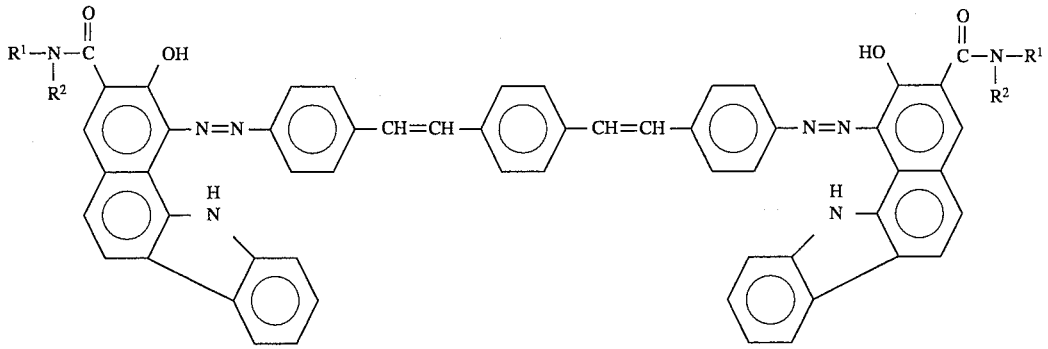
| No. | $R^1$ | $R^2$ |
|---|---|---|
| 109 | $-H$ | 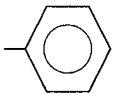 |
| 110 | $-CH_3$ | 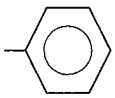 |
| 111 | $-H$ | 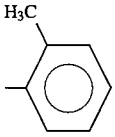 |
| 112 | $-H$ | 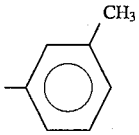 |
| 113 | $-H$ | 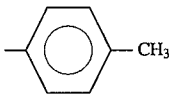 |
| 114 | $-H$ | 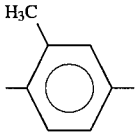 |
| 115 | $-H$ | 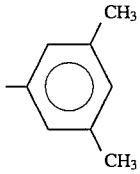 |
| 116 | $-H$ | 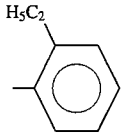 |
| 117 | $-H$ | 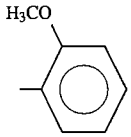 |

TABLE 2-(5)-continued
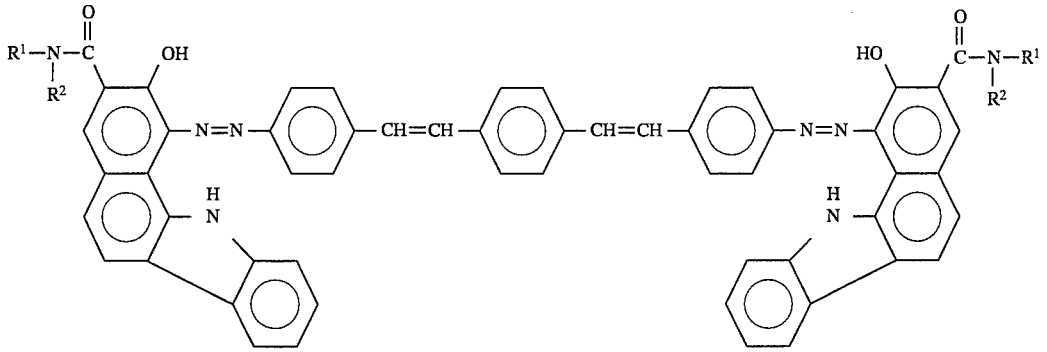
| No. | $R^1$ | $R^2$ |
|---|---|---|
| 118 | −H | 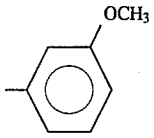 |
| 119 | −H | 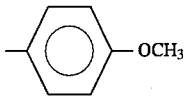 |
| 120 | −H | 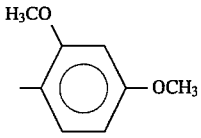 |
| 121 | −H | 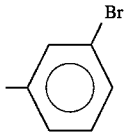 |
| 122 | −H | 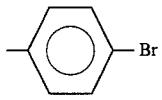 |
| 123 | −H | 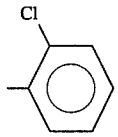 |
| 124 | −H | 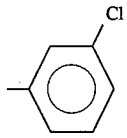 |
| 125 | −H | 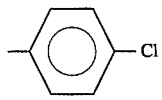 |
| 126 | −H | 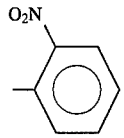 |

TABLE 2-(5)-continued
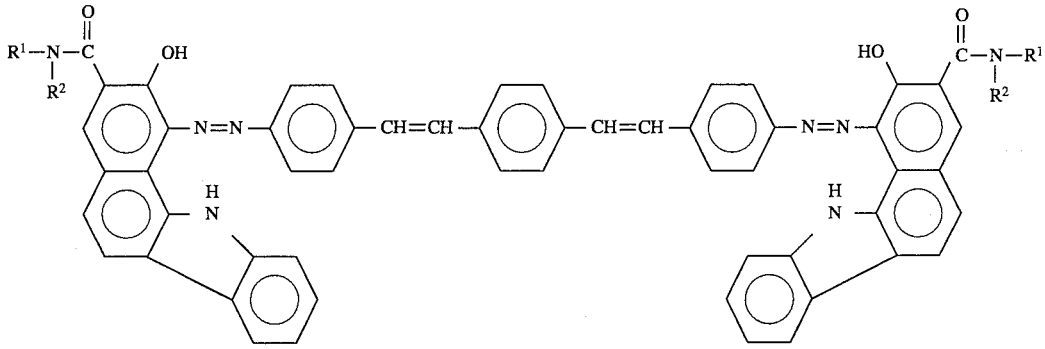
| No. | $R^1$ | $R^2$ |
|---|---|---|
| 127 | −H | 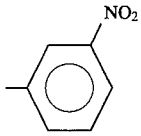 |
| 128 | −H | 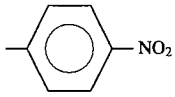 |
| 129 | −H | 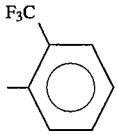 |
| 130 | −H | 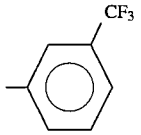 |
| 131 | −H | 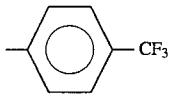 |
| 132 | −H | 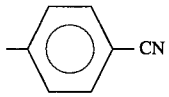 |
| 133 | −H | 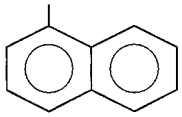 |
| 134 | −H | 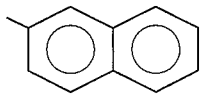 |

TABLE 2-(6)
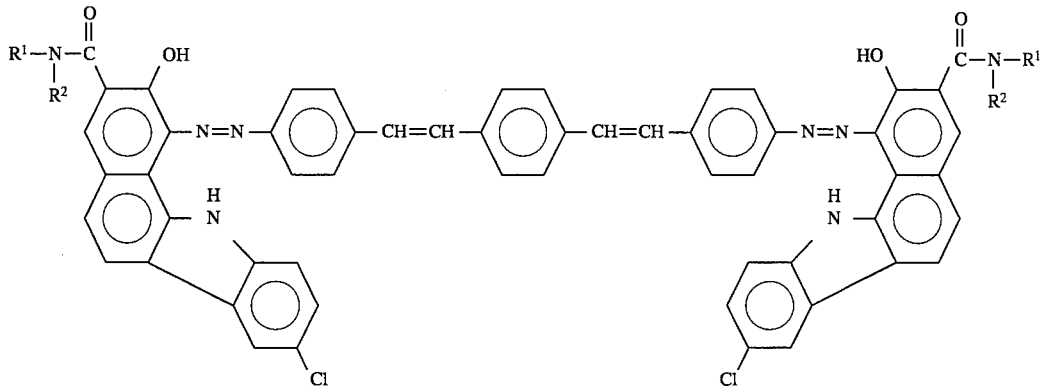
| No. | $R^1$ | $R^2$ |
|---|---|---|
| 135 | −H | 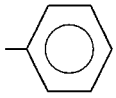 |
| 136 | $-CH_3$ | 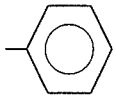 |
| 137 | −H | 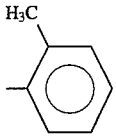 |
| 138 | −H | 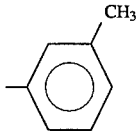 |
| 139 | −H | 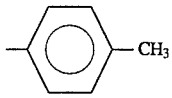 |
| 140 | −H | 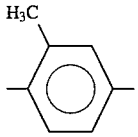 |
| 141 | −H | 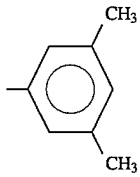 |
| 142 | −H | 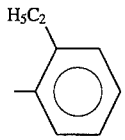 |

TABLE 2-(6)-continued
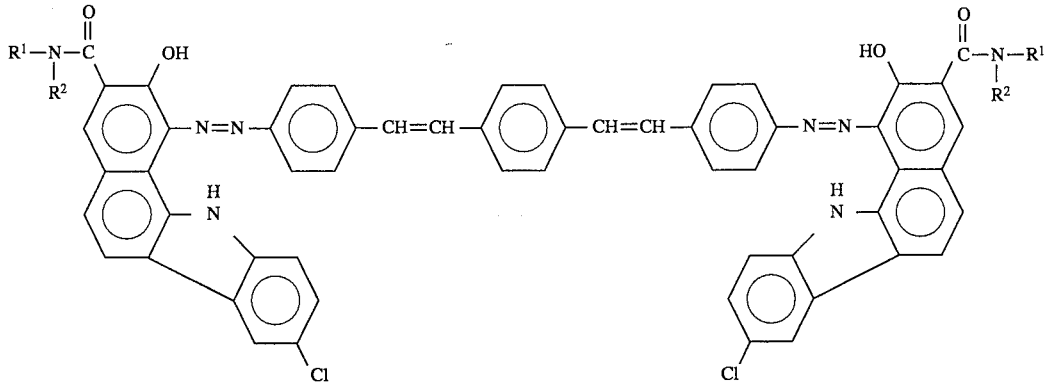
| No. | $R^1$ | $R^2$ |
|---|---|---|
| 143 | −H | 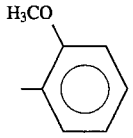 |
| 144 | −H | 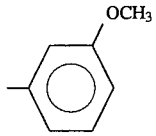 |
| 145 | −H | 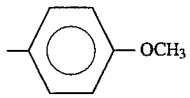 |
| 146 | −H | 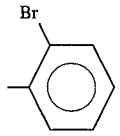 |
| 147 | −H | 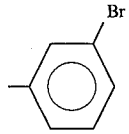 |
| 148 | −H | 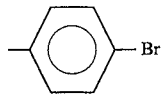 |
| 149 | −H | 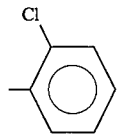 |
| 150 | −H | 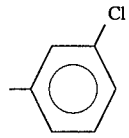 |
| 151 | −H | 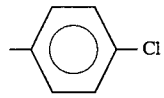 |

TABLE 2-(6)-continued
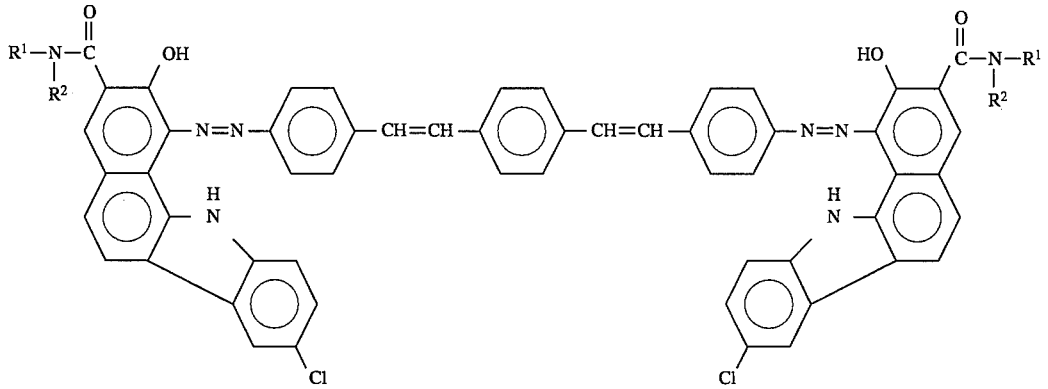
| No. | $R^1$ | $R^2$ |
|---|---|---|
| 152 | −H | 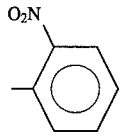 |
| 153 | −H | 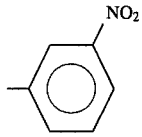 |
| 154 | −H | 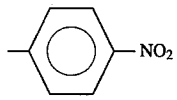 |
| 155 | −H | 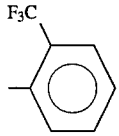 |
| 156 | −H | 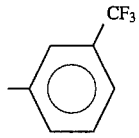 |
| 157 | −H | 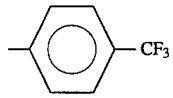 |
| 158 | −H | 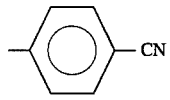 |
| 159 | −H | 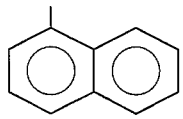 |
| 160 | −H | 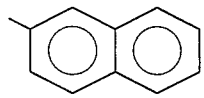 |
The disazo compound represented by formula (3) can also be prepared by a conventionally known method.
For instance, a diamino compound of formula (7) is subjected to diazotation by a conventional method, followed by coupling reaction with a coupler in the presence of an alkali. Alternatively, the diamino compound of formula (7) is subjected to diazotation to obtain a tetrazonium salt. Thereafter, the tetrazonium salt is isolated as a salt of borofluoric acid or a zinc salt, and allowed to react with a coupler in the presence of an alkali in an appropriate organic inactive solvent such as N,N-dimethylformamide or dimethylsulfoxide.

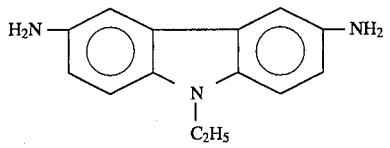

(7)

Specific examples of the disazo compound of formula (3) used as the charge generating material in the present invention are shown in the following Table 3.

TABLE 3-(1)

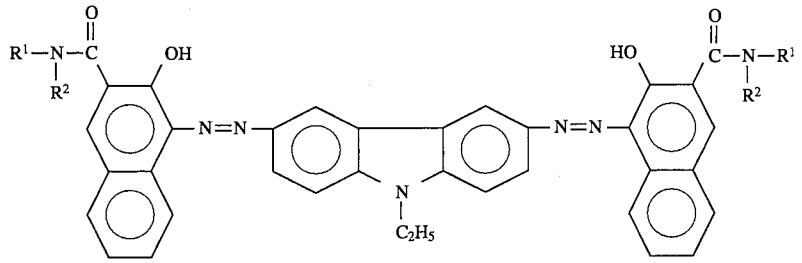

| No. | $R^1$ | $R^2$ |
|---|---|---|
| 1 | −H | 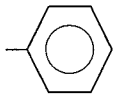 |
| 2 | $-CH_3$ | 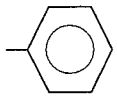 |
| 3 | −H | 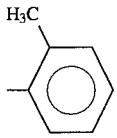 |
| 4 | −H | 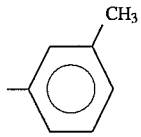 |
| 5 | −H | 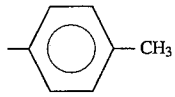 |
| 6 | −H | 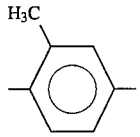 |
| 7 | −H | 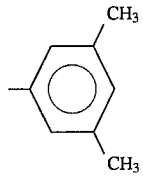 |

TABLE 3-(1)-continued
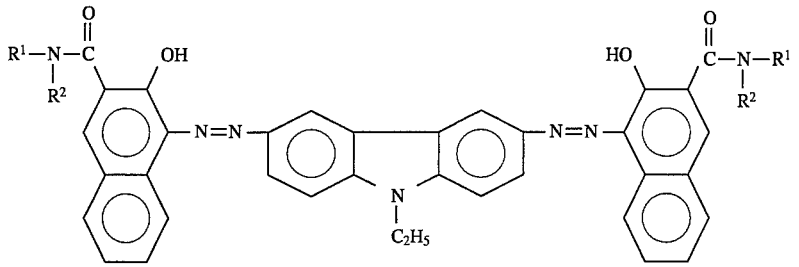
| No. | $R^1$ | $R^2$ |
|---|---|---|
| 8 | —H | 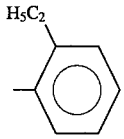 |
| 9 | —H | 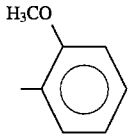 |
| 10 | —H | 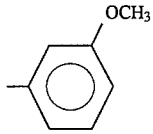 |
| 11 | —H | 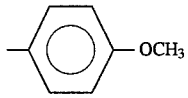 |
| 12 | —H | 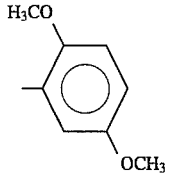 |
| 13 | —H | 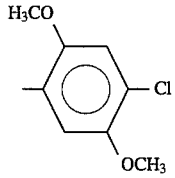 |
| 14 | —H | 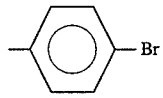 |
| 15 | —H | 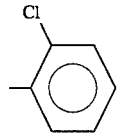 |
| 16 | —H | 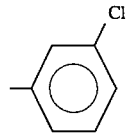 |

TABLE 3-(1)-continued
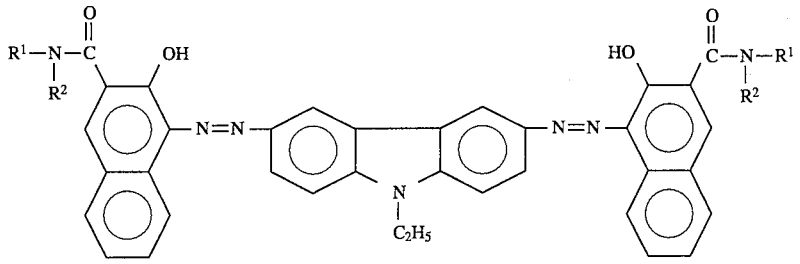
| No. | $R^1$ | $R^2$ |
|---|---|---|
| 17 | −H | 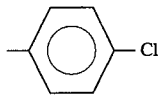 |
| 18 | −H | 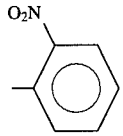 |
| 19 | −H | 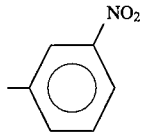 |
| 20 | −H | 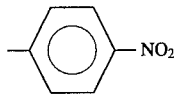 |
| 21 | −H | 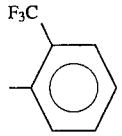 |
| 22 | −H | 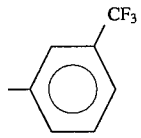 |
| 23 | −H | 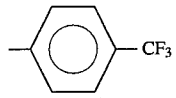 |
| 24 | −H | 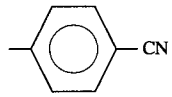 |
| 25 | −H | 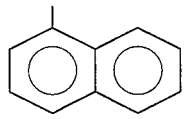 |
| 26 | −H | 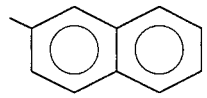 |

TABLE 3-(2)
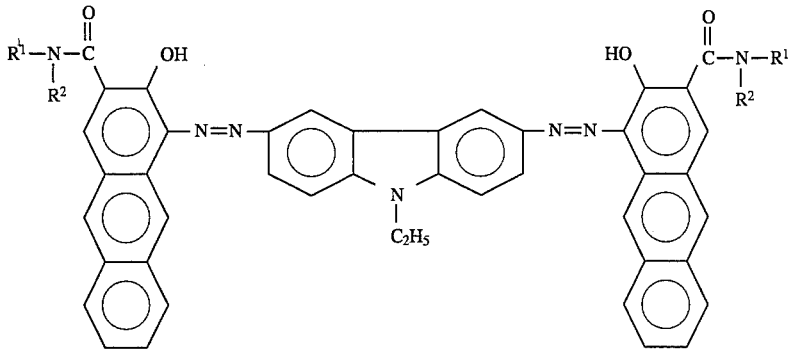
| No. | $R^1$ | $R^2$ |
|---|---|---|
| 27 | $-H$ | 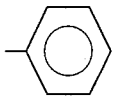 |
| 28 | $-CH_3$ | 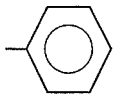 |
| 29 | $-H$ | 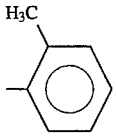 |
| 30 | $-H$ | 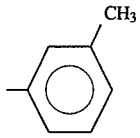 |
| 31 | $-H$ | 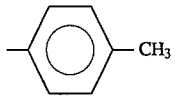 |
| 32 | $-H$ | 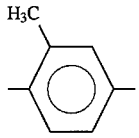 |
| 33 | $-H$ | 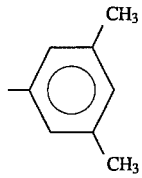 |
| 34 | $-H$ | 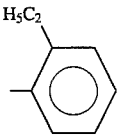 |
| 35 | $-H$ | 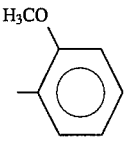 |

TABLE 3-(2)-continued
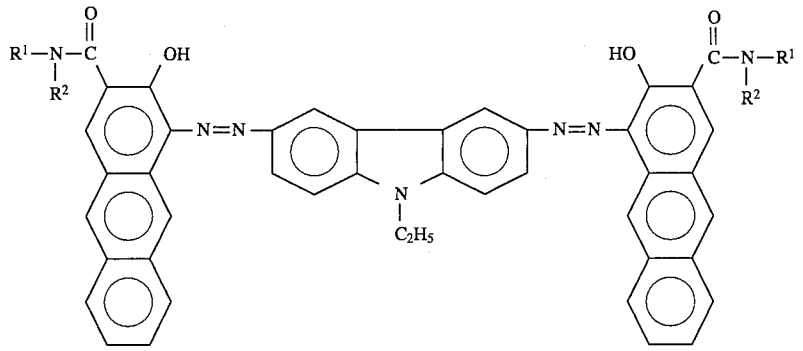
| No. | $R^1$ | $R^2$ |
|---|---|---|
| 36 | −H | 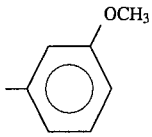 |
| 37 | −H | 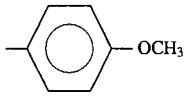 |
| 38 | −H | 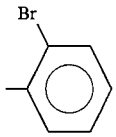 |
| 39 | −H | 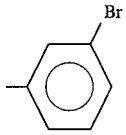 |
| 40 | −H | 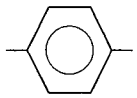 |
| 41 | −H | 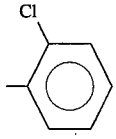 |
| 42 | −H | 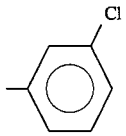 |
| 43 | −H | 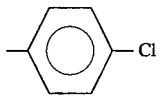 |
| 44 | −H | 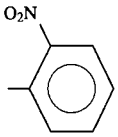 |

TABLE 3-(2)-continued
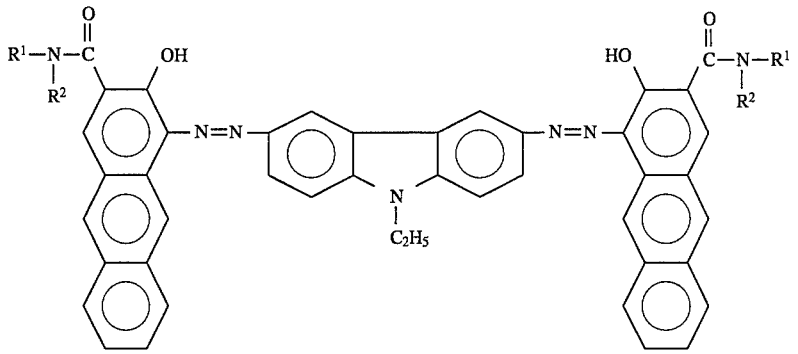
| No. | $R^1$ | $R^2$ |
|---|---|---|
| 45 | −H | 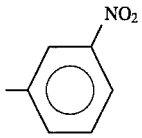 |
| 46 | −H | 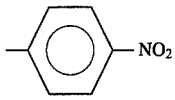 |
| 47 | −H | 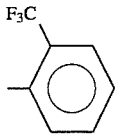 |
| 48 | −H | 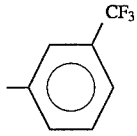 |
| 49 | −H | 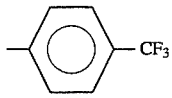 |
| 50 | −H | 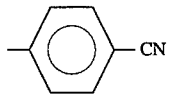 |
| 51 | −H | 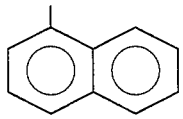 |
| 52 | −H | 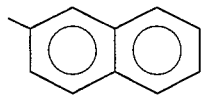 |

TABLE 3-(3)
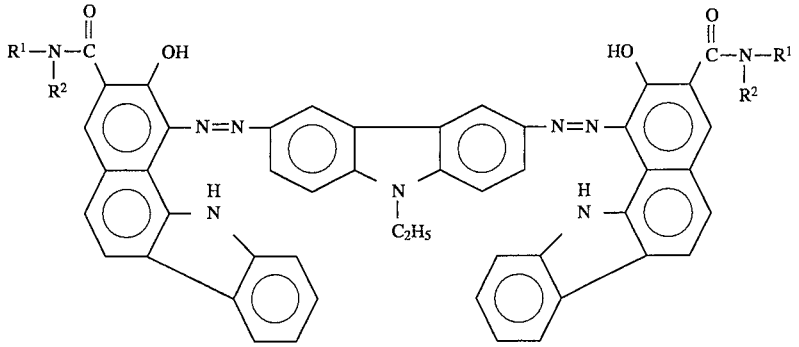
| No. | $R^1$ | $R^2$ |
|---|---|---|
| 53 | $-H$ | 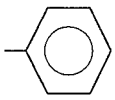 |
| 54 | $-CH_3$ | 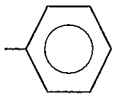 |
| 55 | $-H$ | 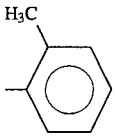 |
| 56 | $-H$ | 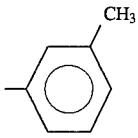 |
| 57 | $-H$ | 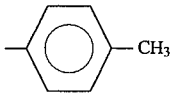 |
| 58 | $-H$ | 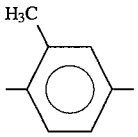 |
| 59 | $-H$ | 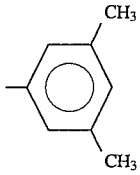 |
| 60 | $-H$ | 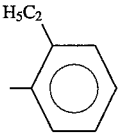 |
| 61 | $-H$ | 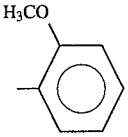 |

TABLE 3-(3)-continued
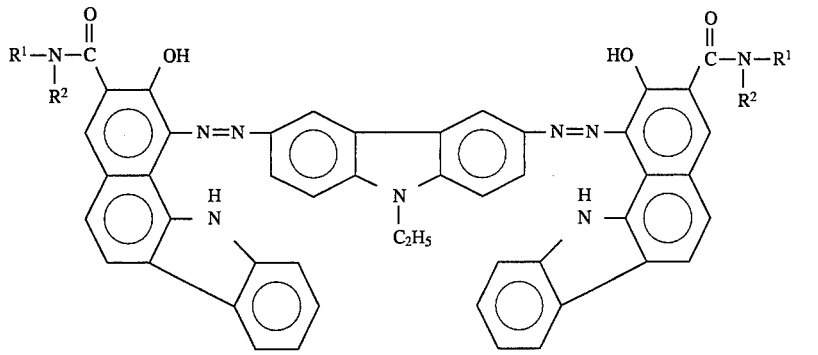
| No. | $R^1$ | $R^2$ |
|---|---|---|
| 62 | −H | 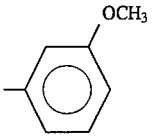 |
| 63 | −H | 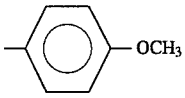 |
| 64 | −H | 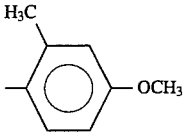 |
| 65 | −H | 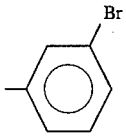 |
| 66 | −H | 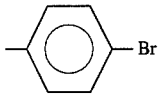 |
| 67 | −H | 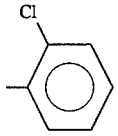 |
| 68 | −H | 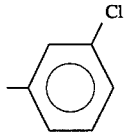 |
| 69 | −H | 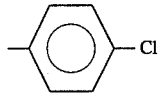 |
| 70 | −H | 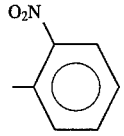 |

TABLE 3-(3)-continued

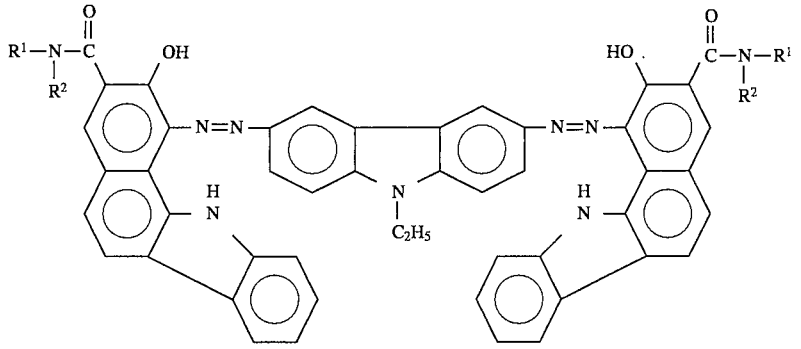

| No. | $R^1$ | $R^2$ |
|---|---|---|
| 71 | −H | 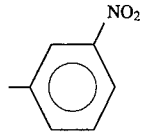 |
| 72 | −H | 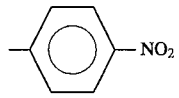 |
| 73 | −H | 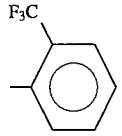 |
| 74 | −H | 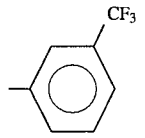 |
| 75 | −H | 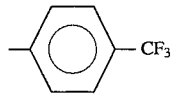 |
| 76 | −H | 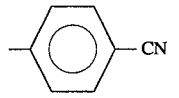 |
| 77 | −H | 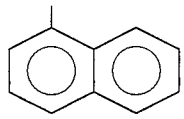 |
| 78 | −H | 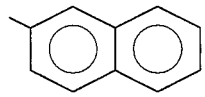 |

The p-type azo pigments of formulas (1) to (3) serving as the charge generating materials in the single-layered electrophotographic photoconductor according to the present invention can be used in combination with any other conventional inorganic or organic charge generating materials which can absorb the visible light and generate free electric charges.

Specific examples of the conventional charge generating materials are inorganic materials such as amorphous selenium, trigonal-system selenium, selenium - arsenic alloy, selenium - tellurium alloy, cadmium sulfide, cadmium sulfoselenide, mercury sulfide, lead oxide, lead sulfide, and amorphous silicon; and organic materials such as bisazo dye, polyazo dye, cyanine dye, styryl dye, pyrylium dye, quinacridone dye, indigo dye, perylene dye, polycyclic quinone dye, bisbenzimidazole dye, indanthrone dye, squarylium dye, anthraquinone dye, and phthalocyanine dye.

Other features of this invention will become apparent in the course of the following description of exemplary embodiments, which are given for illustration of the invention and are not intended to be limiting thereof.

EXAMPLE 1

0.5 g of an azo pigment of formula (I), 10 g of tetrahydrofuran solution in which Z type polycarbonate (hereinafter referred to as PC-Z) was dissolved in an amount of 10 wt. %, and 9 g of tetrahydrofuran were mixed and dispersed in a ball mill to prepare a mixture. To the mixture thus prepared, 10 wt. % solution of the PC-Z, an organic acceptor compound of formula (II), a positive hole transporting material of formula (III) were added so as to obtain a coating liquid for a photoconductive layer comprising the azo pigment component in an amount of 6 wt. %, the PC-Z component in an amount of 50 wt. %, the organic acceptor compound in an amount of 12 wt. % and the positive hole transporting material in an amount of 32 wt. %.

[Azo pigment serving as a charge generating material]

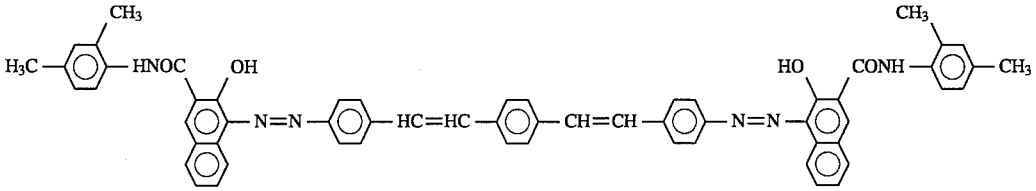

(I)

[Organic acceptor compound]

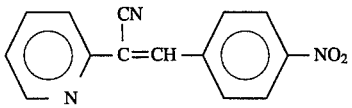

(II)

[Organic positive hole transporting material]

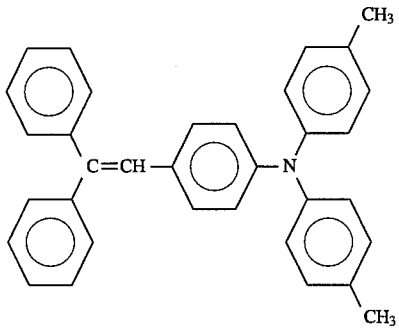

(III)

The above prepared photoconductive layer coating liquid was coated on an aluminum support and dried under application of heat thereto, so that a photoconductive layer with a thickness of about 15 μm was formed on the support. Thus, a single-layered photoconductor according to the present invention was obtained.

Furthermore, the azo pigment of formula (I) was dispersed in the PC-Z to prepare a coating liquid. This coating liquid was coated on an ITO (indium-tin-oxide) glass. The organic positive hole transporting material of formula (III) was dissolved in acetonitrile to prepare a solution of the positive hole transporting material. The oxidation potentials ($E_{ox}$) of the azo pigment (I) serving as a charge generating material, and the organic positive hole transporting material (III) were measured in comparison with the electric potential of a reference electrode SCE. The oxidation potentials of both the azo pigment (I) and the organic positive hole transporting material (III) were 0.7 V. The reduction potentials ($E_{red}$) of the azo pigment (I) and the organic acceptor compound (II) were also measured in the same manner as previously mentioned. The reduction potential ($E_{red}$) of the azo pigment (I) and that of the organic acceptor compound (II) are shown in Table 14.

To evaluate the photosensitivity of the previously obtained single-layered photoconductor of the present invention, it was charged positively in the dark under application of +5.5 kV of corona charge for 20 seconds, using a commercially available electrostatic copying sheet testing apparatus, "Paper Analyzer Model SP-428", made by Kawaguchi Electro Works Co., Ltd., and the charging potential Vs (V) of the photoconductor was measured. The photoconductor was then illuminated by a tungsten lamp of 20 lux and the exposure $E_{1/2}$ (lux.sec) required to reduce the initial charging potential Vs (v) to ½ the initial charging potential Vs (V) was measured. The results are shown in Table 4.

EXAMPLES 2 AND 3 AND COMPARATIVE EXAMPLES 1 AND 2

The procedure for preparation of the single-layered electrophotographic photoconductor according to the present invention in Example 1 was repeated except that the organic positive hole transporting material of formula (III) used in Example 1 was replaced by organic positive hole transporting materials of formulas (IV), (V), (VI) and (VII) respectively in Example 2, Example 3, Comparative Example 1 and Comparative Example 2.

[Organic positive hole transporting material]

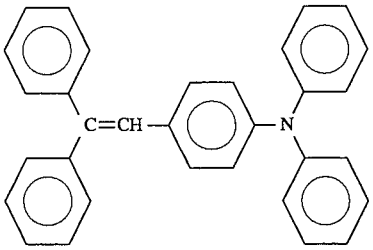

(IV)

[Organic positive hole transporting material]

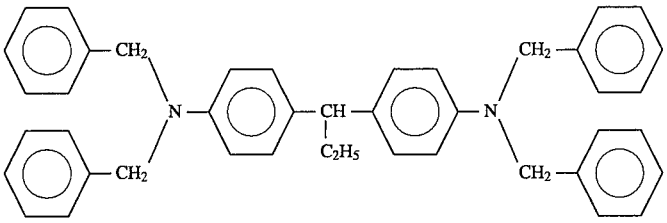

(V)

[Organic positive hole transporting material]

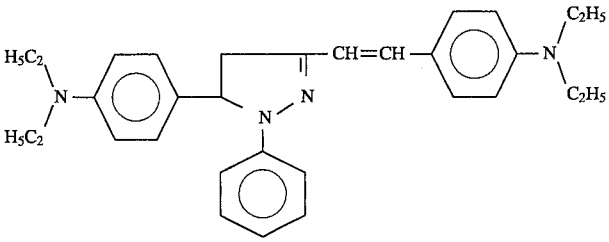

(VI)

[Organic positive hole transporting material]

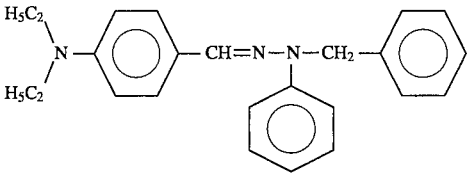

(VII)

The oxidation potential ($E_{ox}$) of each of the organic positive hole transporting materials (IV), (V), (VI) and (VII) was measured in the same manner as in Example 1. The results are shown in Table 14.

The initial charging potential (Vs) and the exposure (E½) required to reduce the initial charging potential (Vs) to ½ the initial charging potential were measured in the same manner as in Example 1. The results are shown in Table 4.

TABLE 4

| Example | Vs (V) | $E_{1/2}$ (lux · s) |
|---|---|---|
| Ex. 1 | 1380 | 0.9 |
| Ex. 2 | 1420 | 1.3 |
| Ex. 3 | 1550 | 1.1 |
| Comp. Ex. 1 | 110 | 5.6 |
| Comp. Ex. 2 | 260 | 2.6 |

EXAMPLE 4

0.5 g of a p-type azo pigment of formula (VIII), 10 g of tetrahydrofuran solution in which PC-Z was dissolved in an amount of 10 wt. %, and 9 g of tetrahydrofuran were mixed and dispersed in a ball mill to prepare a mixture. To the mixture thus prepared, 10 wt. % solution of the PC-Z, an organic acceptor compound of formula (IX), a positive hole transporting material of formula (III) were added so as to obtain a coating liquid for a photoconductive layer comprising the azo pigment component in an amount of 2 wt. %, the PC-Z component in an amount of 50 wt. %, the organic acceptor compound in an amount of 20 wt. % and the positive hole transporting material in an amount of 28 wt. %.

[Azo pigment serving as a charge generating material]

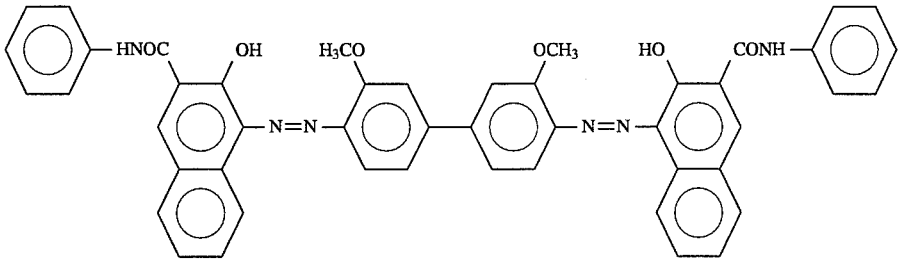

(VIII)

[Organic acceptor compound]

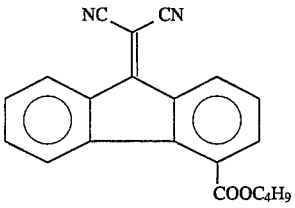

(IX)

[Organic positive hole transporting material]

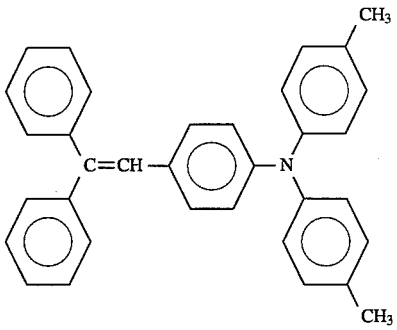

(III)

The above prepared photoconductive layer coating liquid was coated on an aluminum support and dried under application of heat thereto, so that a photoconductive layer with a thickness of about 15 μm was formed on the support. Thus, a single-layered photoconductor according to the present invention was obtained.

Furthermore, the oxidation potentials ($E_{ox}$) of the azo pigment (VIII) serving as a charge generating material, and the organic positive hole transporting material (III) were measured in the same manner as in Example 1. The oxidation potentials of both the azo pigment (VIII) and the organic positive hole transporting material (III) were 0.7 V. The reduction potentials ($E_{red}$) of the azo pigment (VIII) and the organic acceptor compound (IX) were also measured in the same manner as previously mentioned. The reduction potential ($E_{red}$) of the azo pigment (VIII) and that of the organic acceptor compound (IX) are shown in Table 14.

To evaluate the photosensitivity of the previously obtained single-layered photoconductor of the present invention, it was charged positively in the dark under application of +5.5 kV of corona charge for 20 seconds, using a commercially available electrostatic copying sheet testing apparatus, "Paper Analyzer Model SP-428", made by Kawaguchi Electro Works Co., Ltd., and the charging potential Vs (V) of the photoconductor was measured. The photoconductor was then illuminated by a tungsten lamp of 20 lux and the exposure $E_{1/2}$ (lux.sec) required to reduce the initial charging potential Vs (V) to ½ the initial charging potential Vs (V) was measured. The results are shown in Table 5.

EXAMPLES 5 AND 6

The procedure for preparation of the single-layered electrophotographic photoconductor according to the present invention in Example 4 was repeated except that the p-type azo pigment of formula (VIII) used in Example 4 was replaced by p-type azo pigments of formulas (X) and (XI), respectively in Example 5, and Example 6. Thus, single-layered electrophotographic photoconductors according to the present invention were obtained.

[P-type azo pigment]

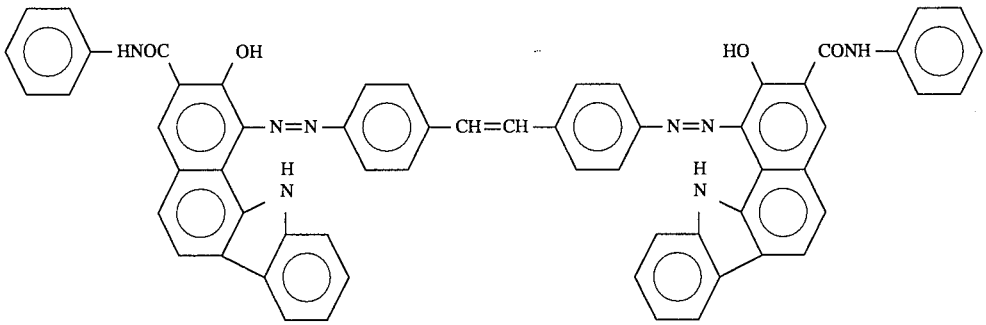

(X)

[P-type azo pigment]

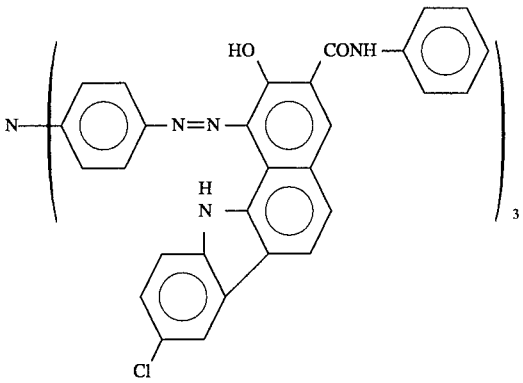

(XI)

The oxidation potential ($E_{ox}$) and the reduction potential ($E_{red}$) of each of the p-type azo pigments (X) and (XI) were measured in the same manner as in Example 1. The results are shown in Table 14.

The initial charging potential (Vs) and the exposure (E½) required to reduce the initial charging potential (Vs) to ½ the initial charging potential were measured in the same manner as in Example 4. The results are shown in Table 5.

EXAMPLE 7

The procedure for preparation of the single-layered electrophotographic photoconductor according to the present invention in Example 4 was repeated except that the organic positive hole transporting material of formula (III) used in Example 4 was replaced by a positive hole transporting material of formula (XII). Thus, a single-layered electrophotographic photoconductor according to the present invention was obtained.

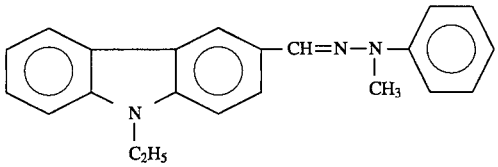

(XII)

The oxidation potential ($E_{ox}$) of the organic positive hole transporting material of formula (XII) was measured in the same manner as in Example 1. The results are shown in Table 14.

The initial charging potential (Vs) and the exposure (E½) required to reduce the initial charging potential (Vs) to ½ the initial charging potential were measured in the same manner as in Example 4. The results are shown in Table 5.

TABLE 5

| Example | Vs (V) | $E_{1/2}$ (lux · s) |
|---|---|---|
| Ex. 4 | 1470 | 4.5 |
| Ex. 5 | 1620 | 4.5 |
| Ex. 6 | 1280 | 1.6 |
| Ex. 7 | 1510 | 2.1 |

EXAMPLE 8

0.5 g of an azo pigment of formula (I), 10 g of tetrahydrofuran solution in which PC-Z was dissolved in an amount of 10 wt. %, and 9 g of tetrahydrofuran were mixed and dispersed in a ball mill to prepare a mixture. To the mixture thus prepared, 10 wt. % solution of the PC-Z, an organic acceptor compound of formula (IX), a positive hole transporting material of formula (III) were added so as to obtain a coating liquid for a photoconductive layer comprising the azo pigment component in an amount of 2 wt. %, the PC-Z component in an amount of 50 wt. %, the organic acceptor compound in an amount of 20 wt. % and the positive hole transporting material in an amount of 28 wt. %.

[Azo pigment serving as a charge generating material]

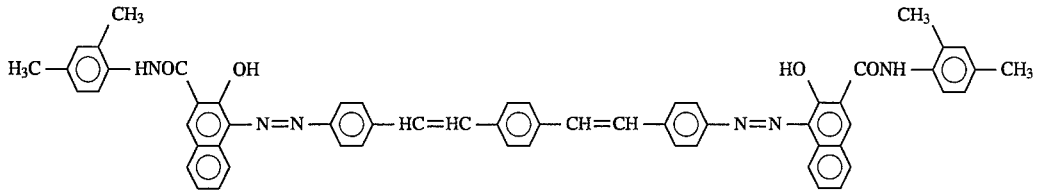

(I)

[Organic acceptor compound]

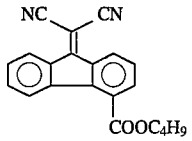

(IX)

[Organic positive hole transporting material]

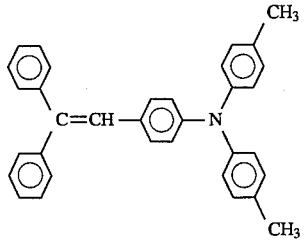

(III)

The above prepared photoconductive layer coating liquid was coated on an aluminum support and dried under application of heat thereto, so that a photoconductive layer with a thickness of about 15 μm was formed on the support. Thus, a single-layered photoconductor according to the present invention was obtained.

The oxidation potentials ($E_{ox}$) of the azo pigment (I) serving as a charge generating material and the organic positive hole transporting material (III), and the reduction potentials ($E_{red}$) of the azo pigment (I) and the organic acceptor compound (IX) are shown in Table 14.

To evaluate the photosensitivity of the previously obtained single-layered photoconductor of the present invention, it was charged positively in the dark under application of +5.5 kV of corona charge for 20 seconds, using a commercially available electrostatic copying sheet testing apparatus, "Paper Analyzer Model SP-428", made by Kawaguchi Electro Works Co., Ltd., and the charging potential Vs (V) of the photoconductor was measured. The photoconductor was then illuminated by a tungsten lamp of 20 lux and the exposure $E_{1/2}$ (lux.sec) required to reduce the initial charging potential Vs (V) to ½ the initial charging potential Vs (v) was measured. The results are shown in Table 6.

EXAMPLES 9 AND 10 AND COMPARATIVE EXAMPLES 3 AND 4

The procedure for preparation of the single-layered electrophotographic photoconductor according to the present invention in Example 8 was repeated except that the organic positive hole transporting material of formula (III) used in Example 8 was replaced by organic positive hole transporting materials of formulas (IV), (V), (VI) and (VII), respectively in Example 9, Example 10, Comparative Example 3 and Comparative Example 4.

[Organic positive hole transporting material]

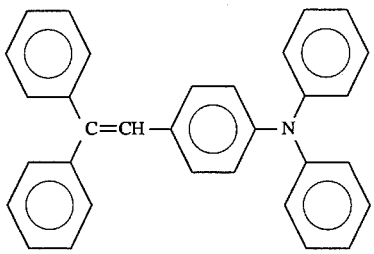

(IV)

[Organic positive hole transporting material]

-continued

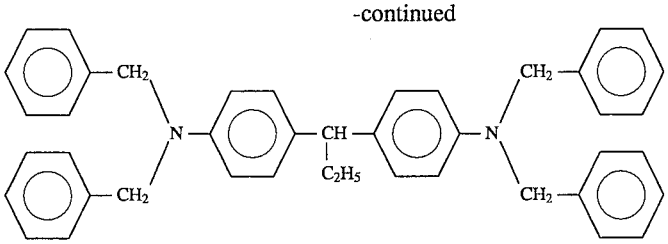

(V)

[Organic positive hole transporting material]

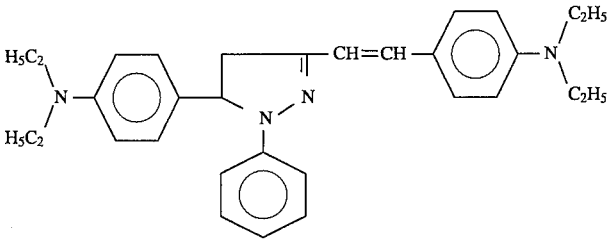

(VI)

[Organic positive hole transporting material]

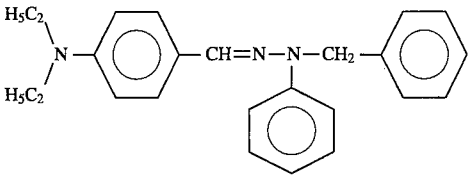

(VII)

The oxidation potentials ($E_{ox}$) of the organic positive hole transporting materials (IV), (V), (VI) and (VII) are shown in Table 14.

The initial charging potential (Vs) and the exposure (E½) required to reduce the initial charging potential (Vs) to ½ the initial charging potential were measured in the same manner as in Example 8. The results are shown in Table 6.

EXAMPLE 11

0.5 g of an azo pigment of formula (XIII), 10 g of tetrahydrofuran solution in which PC-Z was dissolved in an amount of 10 wt. %, and 9 g of tetrahydrofuran were mixed and dispersed in a ball mill to prepare a mixture. To the mixture thus prepared, 10 wt. % solution of the PC-Z, an organic acceptor compound of formula (XIV), a positive hole transporting material of formula (III) were added so as to obtain a coating liquid for a photoconductive layer comprising the azo pigment component in an amount of 5 wt. %, the PC-Z component in an amount of 50 wt. %, the organic acceptor compound in an amount of 15 wt. % and the positive hole transporting material in an amount of 30 wt. %.

[Azo pigment serving as a charge generating material]

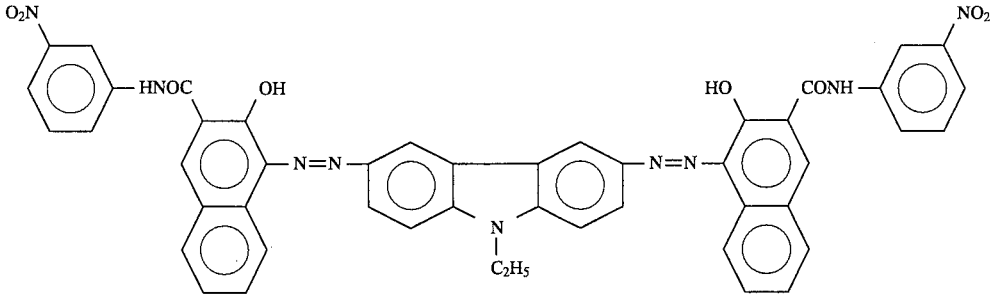

(XIII)

-continued

[Organic acceptor compound]

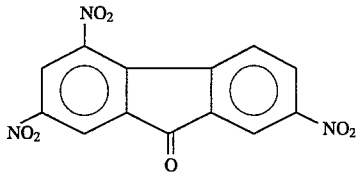

(XIV)

[Organic positive hole transporting material]

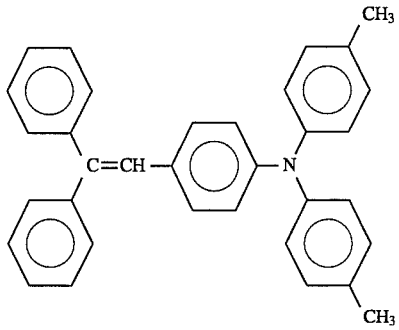

(III)

The above prepared photoconductive layer coating liquid was coated on an aluminum support and dried under application of heat thereto, so that a photoconductive layer with a thickness of about 15 μm was formed on the support. Thus, a single-layered photoconductor according to the present invention was obtained.

The oxidation potentials ($E_{ox}$) of the azo pigment (XIII) serving as a charge generating material and the organic positive hole transporting material (III), and the reduction potentials ($E_{red}$) of the azo pigment (XIII) and the organic acceptor compound (XIV) are shown in Table 14.

The initial charging potential (Vs) and the exposure (E½) required to reduce the initial charging potential (Vs) to ½ the initial charging potential were measured in the same manner as in Example 8. The results are shown in Table 6.

EXAMPLES 12 AND 13

The procedure for preparation of the single-layered electrophotographic photoconductor according to the present invention in Example 11 was repeated except that the organic acceptor compound of formula (XIV) used in Example 11 was replaced by organic acceptor compounds of formulas (XV) and (XVI), respectively in Example 12 and Example 13.

[Organic acceptor compound]

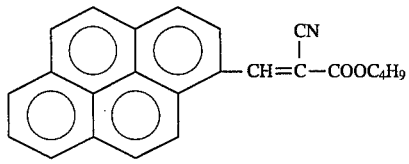

(XV)

[Organic acceptor compound]

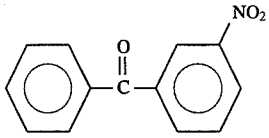

(XVI)

The reduction potentials ($E_{red}$) of the organic acceptor compounds (XV) and (XVI) are shown in Table 14.

The initial charging potential (Vs) and the exposure (E½) required to reduce the initial charging potential (Vs) to ½ the initial charging potential were measured in the same manner as in Example 8. The results are shown in Table 6.

TABLE 6

| Example | Vs (V) | $E_{1/2}$ (lux · s) |
|---|---|---|
| Ex. 8 | 1410 | 0.9 |
| Ex. 9 | 1420 | 1.2 |
| Ex. 10 | 1510 | 1.1 |
| Ex. 11 | 1080 | 2.8 |
| Ex. 12 | 1360 | 5.1 |
| Ex. 13 | 1580 | 6.4 |
| Comp. Ex. 3 | 150 | 5.6 |
| Comp. Ex. 4 | 240 | 2.6 |

The repetition characteristics of the single-layered photoconductors obtained in Examples 8 through 13 and Comparative Examples 3 and 4 were evaluated in such a manner that the surface potential obtained by the charging operation and the surface potential after light exposure were measured at the initial stage and after these operations were repeated 5,000 times. The results are shown in Table 7.

TABLE 7

| | Charging Potential | | Surface Potential after Light Exposure | |
|---|---|---|---|---|
| | At initial Stage | After 5000 times | At initial Stage | After 5000 times |
| Ex. 8 | 830 | 760 | 160 | 180 |
| Ex. 9 | 800 | 700 | 160 | 180 |
| Ex. 10 | 840 | 760 | 180 | 250 |
| Ex. 11 | 810 | 760 | 190 | 210 |
| Ex. 12 | 800 | 610 | 190 | 230 |
| Ex. 13 | 830 | 550 | 240 | 250 |
| Comp. Ex. 3 | 260 | 50 | 40 | 40 |
| Comp. | 510 | 190 | 140 | 160 |

TABLE 7-continued

| | Charging Potential | | Surface Potential after Light Exposure | |
|---|---|---|---|---|
| | At initial Stage | After 5000 times | At initial Stage | After 5000 times |
| Ex. 4 | | | | |

EXAMPLE 14

0.5 g of an azo compound No. 112 in Table 1-(5), 10 g of tetrahydrofuran solution in which PC-Z was dissolved in an amount of 10 wt. %, and 9 g of tetrahydrofuran were mixed and dispersed in a ball mill to prepare a mixture. To the mixture thus prepared, 10 wt. % solution of the PC-Z, an organic acceptor compound of formula (XVII), a positive hole transporting material of formula (III) were added and thoroughly stirred so as to obtain a coating liquid for a photoconductive layer comprising the azo pigment component in an amount of 2 wt. %, the PC-Z component in an amount of 50 wt. %, the organic acceptor compound in an amount of 20 wt. % and the positive hole transporting material in an amount of 28 wt. %.

[Organic acceptor compound]

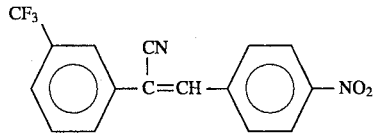

(XVII)

[Organic positive hole transporting material]

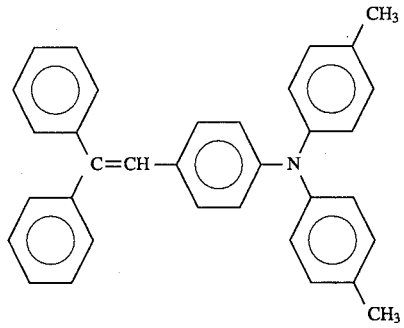

(III)

Aluminum was deposited on a 75-μm-thick polyester film in a deposition amount of 1000 Å to prepare an electroconductive support. The above prepared photoconductive layer coating liquid was coated on an aluminum-deposited surface of the polyester support by a doctor blade and dried, so that a photoconductive layer with a thickness of about 15 μm was formed on the support. Thus, a single-layered photoconductor according to the present invention was obtained.

The oxidation potentials ($E_{ox}$) of the azo compound No. 112 (Table 1-(5)) serving as a charge generating material and the organic positive hole transporting material (III), and the reduction potentials ($E_{red}$) of the azo compound No. 112 and the organic acceptor compound (XVII) are shown in Table 14.

To evaluate the photosensitivity of the previously obtained single-layered photoconductor of the present invention, it was charged positively in the dark under application of +5.5 kV of corona charge for 20 seconds, using a commercially available electrostatic copying sheet testing apparatus, "Paper Analyzer Model SP-428", made by Kawaguchi Electro Works Co., Ltd., and the charging potential Vs (V) of the photoconductor was measured. The photoconductor was allowed to stand in the dark without any application of charge thereto for 20 seconds, and the surface potential (Vo) was measured. The photoconductor was then illuminated by a tungsten lamp of 20 lux and the exposure $E_{1/2}$ (lux.sec) required to reduce the initial charging potential Vs (V) to ½ the initial charging potential Vs (V) was measured. The results are shown in Table 9.

EXAMPLES 15 TO 28

The procedure for preparation of the single-layered electrophotographic photoconductor according to the present invention in Example 14 was repeated except that the azo compound No. 112 in Table 1-(5) used in Example 14 was replaced by each of the azo compounds shown in Table 8. Thus, single-layered electrophotographic photoconductors according to the present invention were obtained.

TABLE 8

| | Azo Compound |
|---|---|
| Ex. 15 | Compound No. 7 in Table 1-(1) |
| Ex. 16 | Compound No. 8 in Table 1-(1) |
| Ex. 17 | Compound No. 9 in Table 1-(1) |
| Ex. 18 | Compound No. 12 in Table 1-(1) |
| Ex. 19 | Compound No. 38 in Table 1-(2) |
| Ex. 20 | Compound No. 64 in Table 1-(3) |
| Ex. 21 | Compound No. 86 in Table 1-(4) |
| Ex. 22 | Compound No. 87 in Table 1-(4) |
| Ex. 23 | Compound No. 107 in Table 1-(5) |
| Ex. 24 | Compound No. 113 in Table 1-(5) |
| Ex. 25 | Compound No. 119 in Table 1-(5) |
| Ex. 26 | Compound No. 138 in Table 1-(6) |
| Ex. 27 | Compound No. 139 in Table 1-(6) |
| Ex. 28 | Compound No. 140 in Table 1-(6) |

The oxidation potentials ($E_{ox}$) of the azo compounds used in Examples 15 through 28 are shown in Table 14.

The initial charging potential (Vs), the surface potential (Vo) after dark decay and the exposure (E½) required to reduce the initial charging potential (Vs) to ½ the initial charging potential were measured in the same manner as in Example 14. The results are shown in Table 9.

EXAMPLE 29

The procedure for preparation of the single-layered electrophotographic photoconductor according to the present invention in Example 14 was repeated except that the organic positive hole transporting material of formula (III) used in Example 14 was replaced by a positive hole transporting material of formula (XVIII). Thus, a single-layered electrophotographic photoconductor according to the present invention was obtained.

[Organic positive hole transporting material]

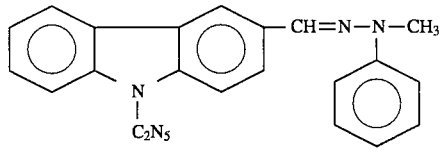

(XVIII)

The oxidation potential ($E_{ox}$) of the positive hole transporting material (XVIII) is shown in Table 14.

The initial charging potential (Vs), the surface potential (Vo) after dark decay and the exposure (E½) required to reduce the initial charging potential (Vs) to ½ the initial charging potential were measured in the same manner as in Example 14. The results are shown in Table 9.

EXAMPLE 30

The procedure for preparation of the single-layered electrophotographic photoconductor according to the present invention in Example 14 was repeated except that the organic acceptor compound of formula (XVII) used in Example 14 was replaced by an organic acceptor compound of formula (IX). Thus, a single-layered electrophotographic photoconductor according to the present invention was obtained.

[Organic acceptor compound]

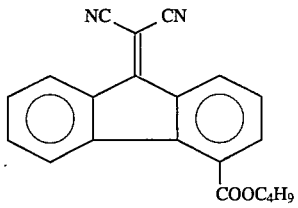

(IX)

The reduction potential ($E_{red}$) of the organic acceptor compound (IX) is shown in Table 14.

The initial charging potential (Vs), the surface potential (Vo) after dark decay and the exposure (E½) required to reduce the initial charging potential (Vs) to ½ the initial charging potential were measured in the same manner as in Example 14. The results are shown in Table 9.

EXAMPLE 31

The procedure for preparation of the single-layered electrophotographic photoconductor according to the present invention in Example 14 was repeated except that the organic acceptor compound of formula (XVII) used in Example 14 was replaced by an organic acceptor compound of formula (XIV). Thus, a single-layered electrophotographic photoconductor according to the present invention was obtained.

[Organic acceptor compound]

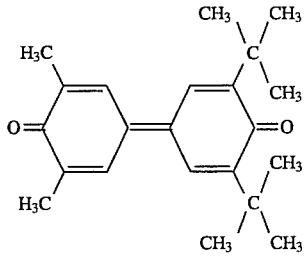

(XIV)

The reduction potential ($E_{red}$) of the organic acceptor compound (XIV) is shown in Table 14.

The initial charging potential (Vs), the surface potential (Vo) after dark decay and the exposure (E½) required to reduce the initial charging potential (Vs) to ½ the initial charging potential were measured in the same manner as in Example 14. The results are shown in Table 9.

TABLE 9

| Example | Vs (V) | Vo (V) | $E_{½}$ (lux · s) |
|---|---|---|---|
| Ex. 14 | 1220 | 1060 | 1.2 |
| Ex. 15 | 1450 | 1360 | 1.8 |
| Ex. 16 | 1320 | 1190 | 1.5 |
| Ex. 17 | 1380 | 1230 | 1.7 |
| Ex. 18 | 1140 | 970 | 1.9 |
| Ex. 19 | 1480 | 1310 | 2.0 |
| Ex. 20 | 1210 | 1050 | 1.8 |
| Ex. 21 | 1350 | 1220 | 1.8 |
| Ex. 22 | 1210 | 1000 | 1.7 |
| Ex. 23 | 1330 | 1030 | 1.7 |
| Ex. 24 | 1220 | 1030 | 1.6 |
| Ex. 25 | 1520 | 1370 | 2.1 |
| Ex. 26 | 1220 | 1010 | 1.2 |
| Ex. 27 | 1410 | 1260 | 1.5 |
| Ex. 28 | 1220 | 1030 | 2.1 |
| Ex. 29 | 1160 | 1010 | 1.2 |
| Ex. 30 | 1200 | 1060 | 1.2 |
| Ex. 31 | 1360 | 1190 | 1.5 |

EXAMPLE 32

0.5 g of an azo compound No. 7 in Table 2-(1), 10 g of tetrahydrofuran solution in which PC-Z was dissolved in an amount of 10 wt. %, and 9 g of tetrahydrofuran were mixed and dispersed in a ball mill to prepare a mixture. To the mixture thus prepared, 10 wt. % solution of the PC-Z, an organic acceptor compound of formula (XVII), a positive hole transporting material of formula (III) were added and thoroughly stirred so as to obtain a coating liquid for a photoconductive layer comprising the azo pigment component in an amount of 2 wt. %, the PC-Z component in an amount of 50 wt. %, the organic acceptor compound in an amount of 20 wt. % and the positive hole transporting material in an amount of 28 wt. %.

[Organic acceptor compound]

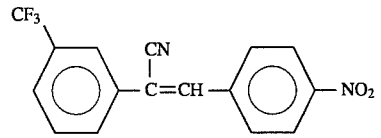

(XVII)

[Organic positive hole transporting material]

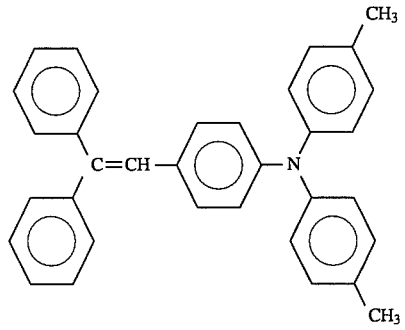

(III)

Aluminum was deposited on a 75-μm-thick polyester film in a deposition amount of 1000 Å to prepare an electroconductive support. The above prepared photoconductive layer coating liquid was coated on an aluminum-deposited surface of the polyester support by a doctor blade and dried, so that a photoconductive layer with a thickness of about 15 μm was formed on the support. Thus, a single-layered photoconductor according to the present invention was obtained.

The oxidation potentials ($E_{ox}$) of the azo compound No. 7 (Table 2-(1)) serving as a charge generating material and the organic positive hole transporting material (III), and the reduction potentials ($E_{red}$) of the azo compound No. 7 and the organic acceptor compound (XVII) are shown in Table 14.

To evaluate the photosensitivity of the previously obtained single-layered photoconductor of the present invention, it was charged positively in the dark under application of +5.5 kV of corona charge for 20 seconds, using a commercially available electrostatic copying sheet testing apparatus, "Paper Analyzer Model SP-428", made by Kawaguchi Electro Works Co., Ltd., and the charging potential Vs (V) of the photoconductor was measured. The photoconductor was allowed to stand in the dark without any application of charge thereto for 20 seconds, and the surface potential (Vo) was measured. The photoconductor was then illuminated by a tungsten lamp of 20 lux and the exposure $E_{1/2}$ (lux.sec) required to reduce the initial charging potential Vs (V) to ½ the initial charging potential Vs (V) was measured. The results are shown in Table 11.

EXAMPLES 33 TO 44

The procedure for preparation of the single-layered electrophotographic photoconductor according to the present invention in Example 32 was repeated except that the azo compound No. 7 in Table 2-(1) used in Example 32 was replaced by each of the azo compounds shown in Table 10. Thus, single-layered electrophotographic photoconductors according to the present invention were obtained.

TABLE 10

| | Azo Compound |
|---|---|
| Ex. 33 | Compound No. 1 in Table 2-(1) |
| Ex. 34 | Compound No. 4 in Table 2-(1) |
| Ex. 35 | Compound No. 5 in Table 2-(1) |
| Ex. 36 | Compound No. 8 in Table 2-(1) |
| Ex. 37 | Compound No. 11 in Table 2-(1) |
| Ex. 38 | Compound No. 27 in Table 2-(1) |
| Ex. 39 | Compound No. 42 in Table 2-(2) |
| Ex. 40 | Compound No. 113 in Table 2-(5) |
| Ex. 41 | Compound No. 116 in Table 2-(5) |
| Ex. 42 | Compound No. 117 in Table 2-(5) |
| Ex. 43 | Compound No. 120 in Table 2-(5) |
| Ex. 44 | Compound No. 140 in Table 2-(6) |

The oxidation potentials ($E_{ox}$) of the azo compounds used in Examples 33 through 44 are shown in Table 14.

The initial charging potential (Vs), the surface potential (Vo) after dark decay and the exposure (E½) required to reduce the initial charging potential (Vs) to ½ the initial charging potential were measured in the same manner as in Example 32. The results are shown in Table 11.

EXAMPLE 45

The procedure for preparation of the single-layered electrophotographic photoconductor according to the present invention in Example 32 was repeated except that the organic positive hole transporting material of formula (III) used in Example 32 was replaced by a positive hole transporting material of formula (XVIII). Thus, a single-layered electrophotographic photoconductor according to the present invention was obtained.

[Organic positive hole transporting material]

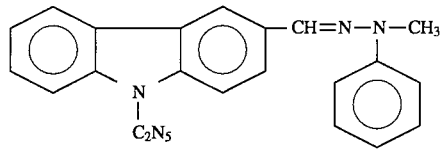

(XVIII)

The oxidation potential ($E_{ox}$) of the positive hole transporting material (XVIII) is shown in Table 14.

The initial charging potential (Vs), the surface potential (Vo) after dark decay and the exposure (E½) required to reduce the initial charging potential (Vs) to ½ the initial charging potential were measured in the same manner as in Example 32. The results are shown in Table 11.

EXAMPLE 46

The procedure for preparation of the single-layered electrophotographic photoconductor according to the present invention in Example 32 was repeated except that the organic acceptor compound of formula (XVII) used in Example 32 was replaced by an organic acceptor compound of formula (XIV). Thus, a single-layered electrophotographic photoconductor according to the present invention was obtained.

[Organic acceptor compound]

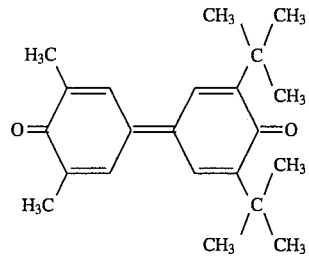

(XIV)

The reduction potential ($E_{red}$) of the organic acceptor compound (XIV) is shown in Table 14.

The initial charging potential (Vs), the surface potential (Vo) after dark decay and the exposure (E½) required to reduce the initial charging potential (Vs) to ½ the initial charging potential were measured in the same manner as in Example 32. The results are shown in Table 11.

TABLE 11

| Example | Vs (V) | Vo (V) | $E_{1/2}$ (lux · s) |
|---|---|---|---|
| Ex. 32 | 1320 | 1020 | 1.2 |
| Ex. 33 | 1430 | 1190 | 1.8 |
| Ex. 34 | 1500 | 1310 | 1.9 |
| Ex. 35 | 1420 | 1240 | 1.7 |
| Ex. 36 | 1220 | 1030 | 1.7 |
| Ex. 37 | 1150 | 950 | 1.5 |
| Ex. 38 | 1240 | 1060 | 1.6 |
| Ex. 39 | 1450 | 1220 | 1.5 |
| Ex. 40 | 1250 | 1030 | 1.4 |
| Ex. 41 | 1200 | 1010 | 1.3 |
| Ex. 42 | 1100 | 920 | 1.5 |
| Ex. 43 | 1470 | 1250 | 1.8 |
| Ex. 44 | 1280 | 1040 | 1.0 |
| Ex. 45 | 1390 | 1060 | 1.3 |
| Ex. 46 | 1240 | 1070 | 1.2 |

EXAMPLE 47

0.5 g of an azo compound No. 19 in Table 3-(1), 10 g of tetrahydrofuran solution in which PC-Z was dissolved in an amount of 10 wt. %, and 9 g of tetrahydrofuran were mixed and dispersed in a ball mill to prepare a mixture. To the mixture thus prepared, 10 wt. % solution of the PC-Z, an organic acceptor compound of formula (XVII), a positive hole transporting material of formula (III) were added and thoroughly stirred so as to obtain a coating liquid for a photoconductive layer comprising the azo pigment component in an amount of 2 wt. %, the PC-Z component in an amount of 50 wt. %, the organic acceptor compound in an amount of 20 wt. % and the positive hole transporting material in an amount of 28 wt. %.

[Organic acceptor compound]

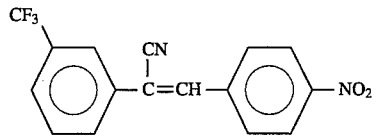

(XVII)

[Organic positive hole transporting material]

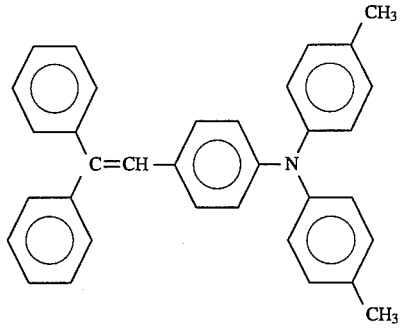

(III)

Aluminum was deposited on a 75-μm-thick polyester film in a deposition amount of 1000 Å to prepare an electroconductive support. The above prepared photoconductive layer coating liquid was coated on an aluminum-deposited surface of the polyester support by a doctor blade and dried, so that a photoconductive layer with a thickness of about 15 μm was formed on the support. Thus, a single-layered photoconductor according to the present invention was obtained.

The oxidation potentials ($E_{ox}$) of the azo compound No. 19 (Table 3-(1)) serving as a charge generating material and the organic positive hole transporting material (III), and the reduction potentials ($E_{red}$) of the azo compound No. 19 and the organic acceptor compound (XVII) are shown in Table 14.

To evaluate the photosensitivity of the previously obtained single-layered photoconductor of the present invention, it was charged positively in the dark under application of +5.5 kV of corona charge for 20 seconds, using a commercially available electrostatic copying sheet testing apparatus, "Paper Analyzer Model SP-428", made by Kawaguchi Electro Works Co., Ltd., and the charging potential Vs (V) of the photoconductor was measured. The photoconductor was allowed to stand in the dark without any application of charge thereto for 20 seconds, and the surface potential (Vo) was measured. The photoconductor was then illuminated by a tungsten lamp of 20 lux and the exposure $E_{1/2}$ (lux.sec) required to reduce the initial charging potential Vs (V) to ½ the initial charging potential Vs (V) was measured. The results are shown in Table 13.

EXAMPLES 48 TO 59

The procedure for preparation of the single-layered electrophotographic photoconductor according to the present invention in Example 47 was repeated except that the azo compound No. 19 in Table 3-(1) used in Example 47 was replaced by each of the azo compounds shown in Table 12. Thus, single-layered electrophotographic photoconductors according to the present invention were obtained.

TABLE 12

| | Azo Compound |
|---|---|
| Ex. 48 | Compound No. 1 in Table 3-(1) |
| Ex. 49 | Compound No. 3 in Table 3-(1) |
| Ex. 50 | Compound No. 5 in Table 3-(1) |
| Ex. 51 | Compound No. 8 in Table 3-(1) |
| Ex. 52 | Compound No. 12 in Table 3-(1) |
| Ex. 53 | Compound No. 13 in Table 3-(1) |
| Ex. 54 | Compound No. 17 in Table 3-(1) |
| Ex. 55 | Compound No. 18 in Table 3-(1) |
| Ex. 56 | Compound No. 20 in Table 3-(1) |
| Ex. 57 | Compound No. 60 in Table 3-(3) |
| Ex. 58 | Compound No. 64 in Table 3-(3) |
| Ex. 59 | Compound No. 69 in Table 3-(3) |

The oxidation potentials ($E_{ox}$) of the azo compounds used in Examples 48 through 59 are shown in Table 14.

The initial charging potential (Vs), the surface potential (Vo) after dark decay and the exposure (E½) required to reduce the initial charging potential (Vs) to ½ the initial charging potential were measured in the same manner as in Example 47. The results are shown in Table 13.

EXAMPLE 60

The procedure for preparation of the single-layered electrophotographic photoconductor according to the present invention in Example 47 was repeated except that the organic positive hole transporting material of formula (III) used in Example 47 was replaced by a positive hole transporting material of formula (XVIII). Thus, a single-layered electrophotographic photoconductor according to the present invention was obtained.

[Organic positive hole transporting material]

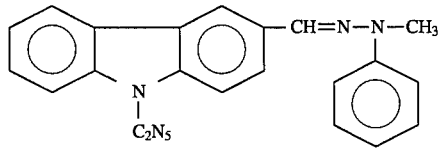

(XVIII)

The oxidation potential ($E_{ox}$) of the positive hole transporting material (XVIII) is shown in Table 14.

The initial charging potential (Vs), the surface potential (Vo) after dark decay and the exposure (E½) required to reduce the initial charging potential (Vs) to ½ the initial charging potential were measured in the same manner as in Example 47. The results are shown in Table 13.

EXAMPLE 61

The procedure for preparation of the single-layered electrophotographic photoconductor according to the present invention in Example 47 was repeated except that the organic acceptor compound of formula (XVII) used in Example 47 was replaced by an organic acceptor compound of formula (IX). Thus, a single-layered electrophotographic photoconductor according to the present invention was obtained.

[Organic acceptor compound]

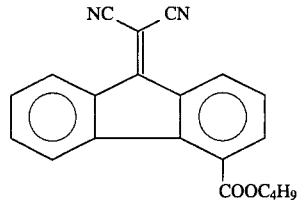

(IX)

The reduction potential ($E_{red}$) of the organic acceptor compound (IX) is shown in Table 14.

The initial charging potential (Vs), the surface potential (Vo) after dark decay and the exposure (E½) required to reduce the initial charging potential (Vs) to ½ the initial charging potential were measured in the same manner as in Example 47. The results are shown in Table 13.

EXAMPLE 62

The procedure for preparation of the single-layered electrophotographic photoconductor according to the present invention in Example 47 was repeated except that the organic acceptor compound of formula (XVII) used in Example 47 was replaced by an organic acceptor compound of formula (XIV). Thus, a single-layered electrophotographic photoconductor according to the present invention was obtained.

[Organic acceptor compound]

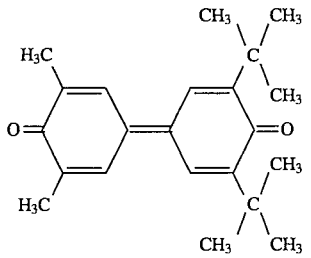

(XIV)

The reduction potential ($E_{red}$) of the organic acceptor compound (XIV) is shown in Table 14.

The initial charging potential (Vs), the surface potential (Vo) after dark decay and the exposure (E½) required to reduce the initial charging potential (Vs) to ½ the initial charging potential were measured in the same manner as in Example 47. The results are shown in Table 13.

TABLE 13

| Example | Vs (V) | Vo (V) | $E_{1/2}$ (lux · s) |
|---|---|---|---|
| Ex. 47 | 1320 | 1200 | 1.2 |
| Ex. 48 | 1520 | 1380 | 2.0 |
| Ex. 49 | 1410 | 1160 | 1.9 |
| Ex. 50 | 1090 | 880 | 1.7 |
| Ex. 51 | 1220 | 1030 | 1.7 |
| Ex. 52 | 1110 | 950 | 2.2 |
| Ex. 53 | 1240 | 1060 | 1.6 |
| Ex. 54 | 1200 | 1050 | 1.4 |
| Ex. 55 | 1250 | 1030 | 1.4 |
| Ex. 56 | 1350 | 1110 | 1.3 |
| Ex. 57 | 1100 | 920 | 1.5 |
| Ex. 58 | 1370 | 1150 | 1.8 |
| Ex. 59 | 1280 | 1040 | 1.3 |
| Ex. 60 | 1400 | 1260 | 1.4 |
| Ex. 61 | 1210 | 1030 | 1.1 |
| Ex. 62 | 1340 | 1170 | 1.2 |

TABLE 14

| | CGM | | Positive Hole Transporting Material | Organic Acceptor Compound |
|---|---|---|---|---|
| | [$E_{ox}$] | [$E_{red}$] | [$E_{ox}$] | [$E_{red}$] |
| Ex. 1 | 0.7 | <−1.2(*) | 0.7 | −0.8 |
| Ex. 2 | 0.7 | <−1.2(*) | 0.8 | −0.8 |
| Ex. 3 | 0.7 | <−1.2(*) | 0.8 | −0.8 |
| Ex. 4 | 0.7 | <−1.2(*) | 0.7 | −0.5 |
| Ex. 5 | 0.7 | −0.8 | 0.7 | −0.5 |
| Ex. 6 | 0.6 | −0.7 | 0.7 | −0.5 |
| Ex. 7 | 0.7 | <−1.2(*) | 0.7 | −0.5 |
| Ex. 8 | 0.7 | <−1.2(*) | 0.7 | −0.5 |
| Ex. 9 | 0.7 | <−1.2(*) | 0.8 | −0.5 |
| Ex. 10 | 0.7 | <−1.2(*) | 0.8 | −0.5 |
| Ex. 11 | 0.7 | −0.8 | 0.7 | −0.4 |
| Ex. 12 | 0.7 | −0.8 | 0.7 | −0.8 |
| Ex. 13 | 0.7 | −0.8 | 0.7 | −1.0 |
| Ex. 14 | 0.5 | −0.8 | 0.7 | −0.8 |
| Ex. 15 | 0.7 | −0.8 | 0.7 | −0.8 |
| Ex. 16 | 0.6 | −0.8 | 0.7 | −0.8 |
| Ex. 17 | 0.7 | −0.8 | 0.7 | −0.8 |
| Ex. 18 | 0.7 | −0.7 | 0.7 | −0.8 |
| Ex. 19 | 0.7 | −0.7 | 0.7 | −0.8 |
| Ex. 20 | 0.7 | −0.8 | 0.7 | −0.8 |
| Ex. 21 | 0.6 | −0.7 | 0.7 | −0.8 |
| Ex. 22 | 0.6 | −0.7 | 0.7 | −0.8 |
| Ex. 23 | 0.5 | −0.8 | 0.7 | −0.8 |
| Ex. 24 | 0.6 | −0.7 | 0.7 | −0.8 |
| Ex. 25 | 0.6 | −0.7 | 0.7 | −0.8 |
| Ex. 26 | 0.6 | −0.7 | 0.7 | −0.8 |
| Ex. 27 | 0.6 | −0.8 | 0.7 | −0.8 |
| Ex. 28 | 0.6 | −0.7 | 0.7 | −0.8 |
| Ex. 29 | 0.5 | −0.8 | 0.7 | −0.8 |
| Ex. 30 | 0.5 | −0.8 | 0.7 | −0.5 |
| Ex. 31 | 0.5 | −0.8 | 0.7 | −0.4 |
| Ex. 32 | 0.7 | <−1.2(*) | 0.7 | −0.8 |
| Ex. 33 | 0.7 | <−1.2(*) | 0.7 | −0.8 |
| Ex. 34 | 0.7 | <−1.2(*) | 0.7 | −0.8 |
| Ex. 35 | 0.7 | <−1.2(*) | 0.7 | −0.8 |
| Ex. 36 | 0.7 | <−1.2(*) | 0.7 | −0.8 |
| Ex. 37 | 0.7 | <−1.2(*) | 0.7 | −0.8 |
| Ex. 38 | 0.7 | <−1.2(*) | 0.7 | −0.8 |
| Ex. 39 | 0.7 | <−1.2(*) | 0.7 | −0.8 |
| Ex. 40 | 0.7 | −0.8 | 0.7 | −0.8 |
| Ex. 41 | 0.7 | −0.9 | 0.7 | −0.8 |
| Ex. 42 | 0.7 | −0.8 | 0.7 | −0.8 |
| Ex. 43 | 0.7 | −0.8 | 0.7 | −0.8 |
| Ex. 44 | 0.7 | −0.8 | 0.7 | −0.8 |
| Ex. 45 | 0.7 | <−1.2(*) | 0.7 | −0.8 |
| Ex. 46 | 0.7 | <−1.2(*) | 0.7 | −0.4 |
| Ex. 47 | 0.7 | −0.8 | 0.7 | −0.8 |
| Ex. 48 | 0.7 | −0.8 | 0.7 | −0.8 |
| Ex. 49 | 0.7 | −0.8 | 0.7 | −0.8 |
| Ex. 50 | 0.7 | −0.8 | 0.7 | −0.8 |
| Ex. 51 | 0.7 | −0.7 | 0.7 | −0.8 |
| Ex. 52 | 0.7 | −0.8 | 0.7 | −0.8 |
| Ex. 53 | 0.7 | −0.8 | 0.7 | −0.8 |
| Ex. 54 | 0.7 | −0.8 | 0.7 | −0.8 |
| Ex. 55 | 0.7 | −0.8 | 0.7 | −0.8 |
| Ex. 56 | 0.7 | −0.8 | 0.7 | −0.8 |
| Ex. 57 | 0.6 | −0.8 | 0.7 | −0.8 |
| Ex. 58 | 0.6 | −0.8 | 0.7 | −0.8 |
| Ex. 59 | 0.6 | −0.8 | 0.7 | −0.8 |
| Ex. 60 | 0.7 | −0.8 | 0.7 | −0.8 |
| Ex. 61 | 0.7 | −0.8 | 0.7 | −0.5 |
| Ex. 62 | 0.7 | −0.8 | 0.7 | −0.4 |
| Comp. Ex. 1 | 0.7 | <−1.2(*) | 0.4 | −0.8 |
| Comp. Ex. 2 | 0.7 | <−1.2(*) | 0.5 | −0.8 |
| Comp. Ex. 3 | 0.7 | <−1.2(*) | 0.4 | −0.5 |
| Comp. Ex. 4 | 0.7 | <−1.2(*) | 0.5 | −0.5 |

TABLE 14-continued

| CGM | | Positive Hole Transporting Material | Organic Acceptor Compound |
|---|---|---|---|
| $[E_{ox}]$ | $[E_{red}]$ | $[E_{ox}]$ | $[E_{red}]$ |

(*) The reduction potantial ($E_{red}$) of the charge generating material (CGM) was less than −1.2 V. The accurate value was immesurable due to the measuring instrument.

As previously explained, the chargeability of the positively-chargeable single-layered electrophotographic photoconductor according to the present invention is excellent because the single-layered photoconductive layer comprises the charge generating material, the organic positive hole transporting material and the organic acceptor compound which are dispersed in the binder agent, with the relationship of the oxidation potential of the charge generating material≦that of the positive hole transporting material being satisfied. In addition to the above, when the relationship of the reduction potential of the charge generating material≦ that of the organic acceptor compound is satisfied, the chargeability, the photosensitivity and the electrostatic characteristics of the photoconductor can be stabilized during the repeated operations.

What is claimed is:

1. A positively-chargeable single-layered type organic electrophotographic photoconductor comprising an electroconductive support and an organic single-layered photoconductive layer comprising a charge generating material, an organic positive hole transporting material and an organic acceptor compound which are dispersed in a matrix binder agent, with the relationship of the oxidation potential ($E_{ox}$) of said charge generating material≦the oxidation potential ($E_{ox}$) of said organic positive hole transporting material being satisfied, wherein the relationship of the reduction potential ($E_{red}$) of said charge generating material≦the reduction potential ($E_{red}$) of said organic acceptor compound is satisfied, and said charge generating material is a p-type (positive-type) azo pigment.

2. The positively-chargeable photoconductor as claimed in claim 1, wherein said p-type azo pigment comprises an electron-donor group.

3. The positively-chargeable photoconductor as claimed in claim 2, wherein said electron-donor group of said p-type azo pigment is selected from the group consisting of phenyl group, biphenyl group, t-phenyl group, stilbene group, styrylstilbene group, carbazole group, ethylcarbazole group, dibenzofuran group, dibenzothiophene group, oxadiazole group, diphenylamine group, and triphenylamine group.

4. The positively-chargeable photoconductor as claimed in claim 1, wherein said p-type azo pigment is a trisazo compound of formula (1):

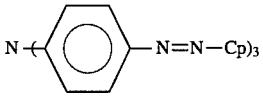

(1)

wherein Cp represents a coupler radical.

5. The positively-chargeable photoconductor as claimed in claim 4, wherein said coupler radical is represented by formula (4):

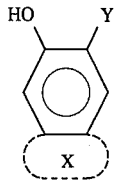

(4)

wherein X represents a cyclic hydrocarbon group which may have a substituent or a heterocyclic group which may have a substituent; and Y represents —CON($R^1$)($R^2$) in which $R^1$ and $R^2$ independently represent hydrogen, a cyclic hydrocarbon group which may have a substituent or a heterocyclic group which may have a substituent, and $R^1$ and $R^2$ may form a ring in combination.

6. The positively-chargeable photoconductor as claimed in claim 1, wherein said p-type azo pigment is a disazo compound of formula (2):

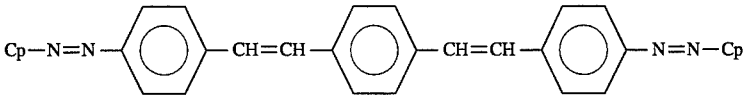

(2)

wherein Cp represents a coupler radical.

7. The positively-chargeable photoconductor as claimed in claim 6, wherein said coupler radical is represented by formula (4):

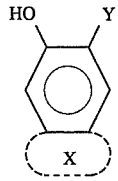

(4)

wherein X represents a cyclic hydrocarbon group which may have a substituent or a heterocyclic group which may have a substituent; and Y represents —CON($R^1$)($R^2$) in which $R^1$ and $R^2$ independently represent hydrogen, a cyclic hydrocarbon group which may have a substituent or a heterocyclic group which may have a substituent, and $R^1$ and $R^2$ may form a ring in combination.

8. The positively-chargeable photoconductor as claimed in claim 1, wherein said p-type azo pigment is a disazo compound of formula (3):

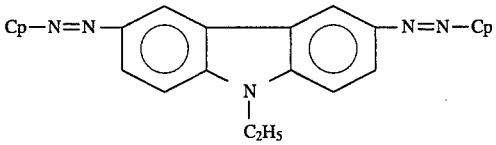

(3)

wherein Cp represents a coupler radical.

9. The positively-chargeable photoconductor as claimed in claim 8, wherein said coupler radical is represented by formula (4):

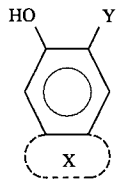

(4)

wherein X represents a cyclic hydrocarbon group which may have a substituent or a heterocyclic group which may have a substituent; and Y represents —CON($R^1$)($R^2$) in which $R^1$ and $R^2$ independently represent hydrogen, a cyclic hydrocarbon group which may have a substituent or a heterocyclic group which may have a substituent, and $R^1$ and $R^2$ may form a ring in combination.

* * * * *

UNITED STATES PATENT AND TRADEMARK OFFICE

CERTIFICATE OF CORRECTION

PATENT NO. : 5,492,784
DATED : FEBRUARY 20, 1996
INVENTOR(S) : MASAO YOSHIKAWA, ET AL.

It is certified that error appears in the above-identified patent and that said Letters Patent is hereby corrected as shown below:

Column 1, line 58, "properties becomes"

should read --properties become--.

Column 86, line 55, "charging potential Vs (v)"

should read --charging potential Vs (V)--.

Column 109, first sentence below Table 14, "(*) the reduction potantial"

should read --(*) the reduction potential--.

Column 109, second sentence below Table 14, "was immesurable"

should read --was immeasurable--.

Signed and Sealed this

Thirty-first Day of March, 1998

*Attest:*

*Attesting Officer*

BRUCE LEHMAN

*Commissioner of Patents and Trademarks*